US010878752B1

(12) United States Patent
Li et al.

(10) Patent No.: US 10,878,752 B1
(45) Date of Patent: Dec. 29, 2020

(54) PIXEL DRIVING CIRCUIT AND DRIVING METHOD, AND DISPLAY DEVICE

(71) Applicant: Shanghai Tianma AM-OLED Co.,Ltd., Shanghai (CN)

(72) Inventors: Yue Li, Shanghai (CN); Xingyao Zhou, Shanghai (CN); Mengmeng Zhang, Shanghai (CN)

(73) Assignee: SHANGHAI TIANMA AM-OLED CO.,LTD., Shanghai (CN)

( * ) Notice: Subject to any disclaimer, the term of this patent is extended or adjusted under 35 U.S.C. 154(b) by 0 days.

(21) Appl. No.: 16/903,100

(22) Filed: Jun. 16, 2020

(30) Foreign Application Priority Data

Apr. 17, 2020 (CN) ..... 2020 1 0304343

(51) Int. Cl.
*G09G 3/325* (2016.01)

(52) U.S. Cl.
CPC ..... *G09G 3/325* (2013.01); *G09G 2300/0426* (2013.01); *G09G 2310/0243* (2013.01); *G09G 2310/08* (2013.01); *G09G 2330/021* (2013.01)

(58) Field of Classification Search
CPC ..... G09G 3/325; G09G 2300/0426; G09G 2310/0243; G09G 2310/08; G09G 2330/021
See application file for complete search history.

(56) References Cited

U.S. PATENT DOCUMENTS

| | | | | |
|---|---|---|---|---|
| 10,522,068 | B2 * | 12/2019 | Furihata | G09G 3/3696 |
| 10,546,520 | B2 * | 1/2020 | Noh | G09G 3/20 |
| 10,643,534 | B2 * | 5/2020 | Jinta | G09G 3/3233 |
| 10,732,768 | B2 * | 8/2020 | Park | G09G 3/3688 |

FOREIGN PATENT DOCUMENTS

| | | | |
|---|---|---|---|
| CN | 102783025 | A | 11/2012 |
| CN | 105405399 | A | 3/2016 |
| CN | 107665672 | A | 2/2018 |
| CN | 108735153 | A | 11/2018 |
| CN | 110491338 | A | 11/2019 |

* cited by examiner

*Primary Examiner* — Sejoon Ahn
(74) *Attorney, Agent, or Firm* — Anova Law Group PLLC

(57) ABSTRACT

A pixel driving circuit includes a first power signal terminal and a second power signal terminal; a driving transistor including a gate electrode connected to a first node, a first end connected to a second node, and a second end connected to a third node; a light-emitting component, connected in series between a fourth node and the second power signal terminal; a first initialization unit including a first end connected to the first node, a second end connected to a first initialization signal terminal, and a control terminal connected to a first control signal terminal; and a second initialization unit including a first end connected to the first node, a second end connected to a second initialization signal terminal, and a control terminal connected to a second control signal terminal. In a same timeframe, polarities of the voltage signals at the first and second initialization signal terminals are opposite.

19 Claims, 11 Drawing Sheets

PIXEL DRIVING CIRCUIT AND DRIVING METHOD, AND DISPLAY DEVICE

CROSS-REFERENCES TO RELATED APPLICATIONS

This application claims the priority of Chinese patent application No. 202010304343.2, filed on Apr. 17, 2020, the entirety of which is incorporated herein by reference.

FIELD

The present disclosure generally relates to the field of display technology and, more particularly, relates to a pixel driving circuit and driving method, and a display device.

BACKGROUND

An organic light-emitting display device is featured with advantages such as self-illumination, low driving voltage, high luminous efficiency, fast responding speed, thin and light, high contrast, etc., and is considered to be next-generation display device with the most developmental potential. The organic light-emitting display device is more and more widely used in a mobile phone, a computer, a television, a car display device, a wearable device, or any other suitable display device having a display function.

A pixel in the organic light-emitting display device includes a pixel driving circuit. A driving transistor in the pixel driving circuit generates a driving current, and a light-emitting component emits light in response to the driving current. The driving current generated by the driving transistor is related to the potential of a gate of the driving transistor. The gate electrode of the driving transistor is connected to a storage capacitor.

At present, a wearable device often has two display modes: one is low-frequency display mode, and another one is normal-frequency display mode. In the low-frequency display mode, the light-emitting component relies on the storage capacitor to maintain the potential. Within a time-length of one frame, the leakage current of the storage capacitor will reduce the potential of the gate of the driving transistor, and the brightness of the light-emitting component gradually increases. Because in the low-frequency display mode, the number of refreshing pixels in the display device is small, which causes different display brightness of each frame of the display device. Thus, an obvious flicker phenomenon will occur, which seriously affects the display effect of the display device. The disclosed pixel driving circuit and driving method, and display device are directed to solve one or more problems set forth above and other problems.

SUMMARY

One aspect of the present disclosure provides a pixel driving circuit. The pixel driving circuit includes a first power signal terminal, a second power signal terminal, a driving transistor, a light-emitting component, a storage unit, a first initialization unit, and a second initialization unit. A gate electrode of the driving transistor is connected to a first node, a first end of the driving transistor is connected to a second node, and a second end of the driving transistor is connected to a third node. The light-emitting component is connected in series between a fourth node and the second power signal terminal. A first end of the storage unit is connected to a fixed potential, and a second end of the storage unit is electrically connected to the first node. A first end of the first initialization unit is connected to the first node, a second end of the first initialization unit is connected to a first initialization signal terminal, and a control terminal of the first initialization unit is connected to a first control signal terminal. A first end of the second initialization unit is connected to the first node, a second end of the second initialization unit is connected to a second initialization signal terminal, and a control terminal of the second initialization unit is connected to a second control signal terminal. The pixel driving circuit is configured to operate in a first-frequency driving mode at a first frequency and a second-frequency driving mode at a second frequency, where the first frequency is less than the second frequency. In the first-frequency driving mode: in an initialization stage, the first initialization unit is turned on, the second initialization unit is turned off, and a voltage signal at the first initialization signal terminal is transmitted to the first node. In the second-frequency driving mode: in an initialization stage, the second initialization unit is turned on, the first initialization unit is turned off, and a voltage signal at the second initialization signal terminal is transmitted to the first node. In a time-length of one frame, polarities of the voltage signals at the first initialization signal terminal and the second initialization signal terminal are opposite. In a light-emitting stage, the first initialization unit and the second initialization unit both are turned off.

Another aspect of the present disclosure provides a driving method of a pixel driving circuit. The driving method includes providing a pixel driving circuit. The pixel driving circuit includes a first power signal terminal, a second power signal terminal, a driving transistor, a light-emitting component, a storage unit, a first initialization unit, and a second initialization unit. A gate electrode of the driving transistor is connected to a first node, a first end of the driving transistor is connected to a second node, and a second end of the driving transistor is connected to a third node. The light-emitting component is connected in series between a fourth node and the second power signal terminal. A first end of the storage unit is connected to a fixed potential, and a second end of the storage unit is electrically connected to the first node. A first end of the first initialization unit is connected to the first node, a second end of the first initialization unit is connected to a first initialization signal terminal, and a control terminal of the first initialization unit is connected to a first control signal terminal. A first end of the second initialization unit is connected to the first node, a second end of the second initialization unit is connected to a second initialization signal terminal, and a control terminal of the second initialization unit is connected to a second control signal terminal. The pixel driving circuit is configured to operate in a first-frequency driving mode at a first frequency and a second-frequency driving mode at a second frequency, where the first frequency is less than the second frequency. The driving method also includes in the first-frequency driving mode: in the initialization stage, sending a first control signal from the first control signal terminal to the first initialization unit, and sending a second control signal from the second control signal terminal to the second initialization signal terminal, such that the first initialization unit is turned on, the second initialization unit is turned off, and a voltage signal is transmitted from the first initialization signal terminal to the first node. In addition, the driving method includes in the second-frequency driving mode: in the initialization stage, sending a third control signal from the first control signal terminal to the first initialization unit, and sending a fourth control signal from the second control signal terminal to the second initialization signal terminal, such that the second initialization unit is turned on, the first initialization unit is turned off, and a voltage signal is transmitted from the second initialization signal terminal to the first node. In a time-length of one frame, polarities of the voltage signals at the first initialization signal terminal and the second initialization signal terminal are opposite. Further, the driving method includes in a light-emitting stage, turning off the first initialization unit and the second initialization unit.

Another aspect of the present disclosure provides a display device. The display device includes a pixel driving circuit. The pixel driving circuit includes a first power signal terminal, a second power signal terminal, a driving transistor, a light-emitting component, a storage unit, a first initialization unit, and a second initialization unit. A gate electrode of the driving transistor is connected to a first node, a first end of the driving transistor is connected to a second node, and a second end of the driving transistor is connected to a third node. The light-emitting component is connected in series between a fourth node and the second power signal terminal. A first end of the storage unit is connected to a fixed potential, and a second end of the storage unit is electrically connected to the first node. A first end of the first initialization unit is connected to the first node, a second end of the first initialization unit is connected to a first initialization signal terminal, and a control terminal of the first initialization unit is connected to a first control signal terminal. A first end of the second initialization unit is connected to the first node, a second end of the second initialization unit is connected to a second initialization signal terminal, and a control terminal of the second initialization unit is connected to a second control signal terminal. The pixel driving circuit is configured to operate in a first-frequency driving mode at a first frequency and a second-frequency driving mode at a second frequency, where the first frequency is less than the second frequency. In the first-frequency driving mode: in an initialization stage, the first initialization unit is turned on, the second initialization unit is turned off, and a voltage signal at the first initialization signal terminal is transmitted to the first node. In the second-frequency driving mode: in an initialization stage, the second initialization unit is turned on, the first initialization unit is turned off, and a voltage signal at the second initialization signal terminal is transmitted to the first node. In a time-length of one frame, polarities of the voltage signals at the first initialization signal terminal and the second initialization signal terminal are opposite. In a light-emitting stage, the first initialization unit and the second initialization unit both are turned off.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION OF THE DISCLOSURE

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

The terms used in the disclosed embodiments of the present disclosure are merely for the purpose of describing specific embodiments and are not intended to limit the present disclosure. Similar reference numbers and letters represent similar terms in the following Figures, such that once an item is defined in one Figure, it does not need to be further discussed in subsequent Figures.

Figure 1:
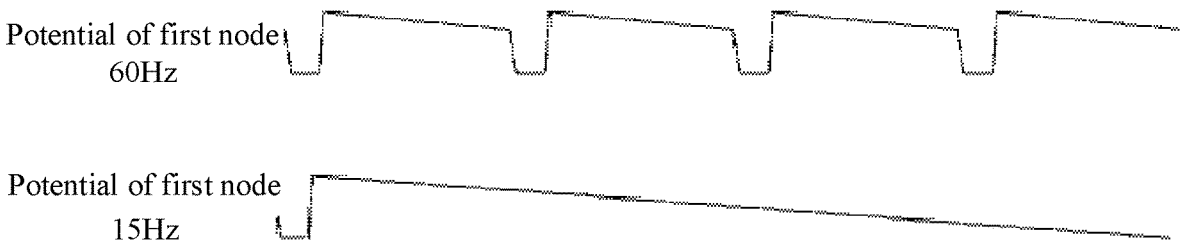
FIG. 1 illustrates a comparison diagram of gate potentials of a driving transistor in two display modes with different frequencies in the existing technology.
Figure 2:
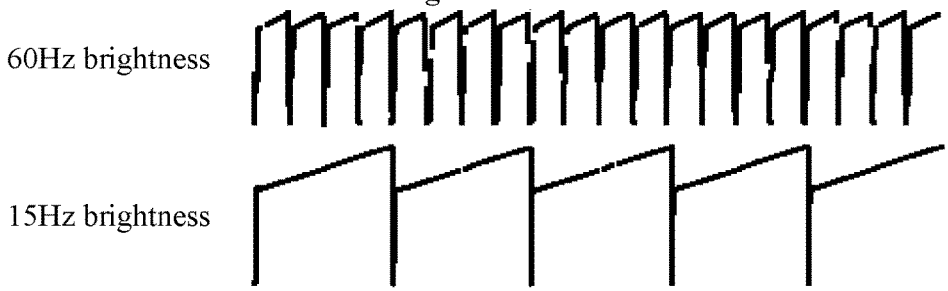
FIG. 2 illustrates a comparison diagram of brightness of a light-emitting component in two display modes with different frequencies in the existing technology.

At present, a wearable product often uses a low-frequency display in an idle mode. A normal display frequency of 60 Hz and a low-frequency display frequency of 15 Hz are used as an example. When displaying with a frequency of 15 Hz, a pixel relies on a storage capacitor to maintain the potential. Within a time-length of one frame, the leakage current of the storage capacitor reduces the potential of a node electrically connected to a gate electrode of a driving transistor in the pixel driving circuit, and gradually increases the brightness of the light-emitting component. FIG. 1 illustrates a comparison diagram of gate potentials of a driving transistor in two display modes with different frequencies in the existing technology; and FIG. 2 illustrates a comparison diagram of brightness of a light-emitting component in two display modes with different frequencies in the existing technology. Referring to FIG. 1 and FIG. 2, in the 60 Hz display mode, the gate potential of the driving transistor is well maintained, and the brightness is substantially uniform. While in the 15 Hz display mode, the number of refreshing pixels in the display device is substantially small, and the gate potential of the driving transistor is substantially poorly maintained, which causes different display brightness of each frame of the display device. Thus, an obvious flicker phenomenon will occur, which seriously affects the display effect of the low-frequency display.

The present disclosure provides a pixel driving circuit and a display device. A first initialization unit and a second initialization unit electrically connected to a first node may be introduced, to realize the compensation of the potential of the first node, which may facilitate to reduce or eliminate the flicker phenomenon occurred in the display device in the driving mode at low frequencies.

Figure 3:
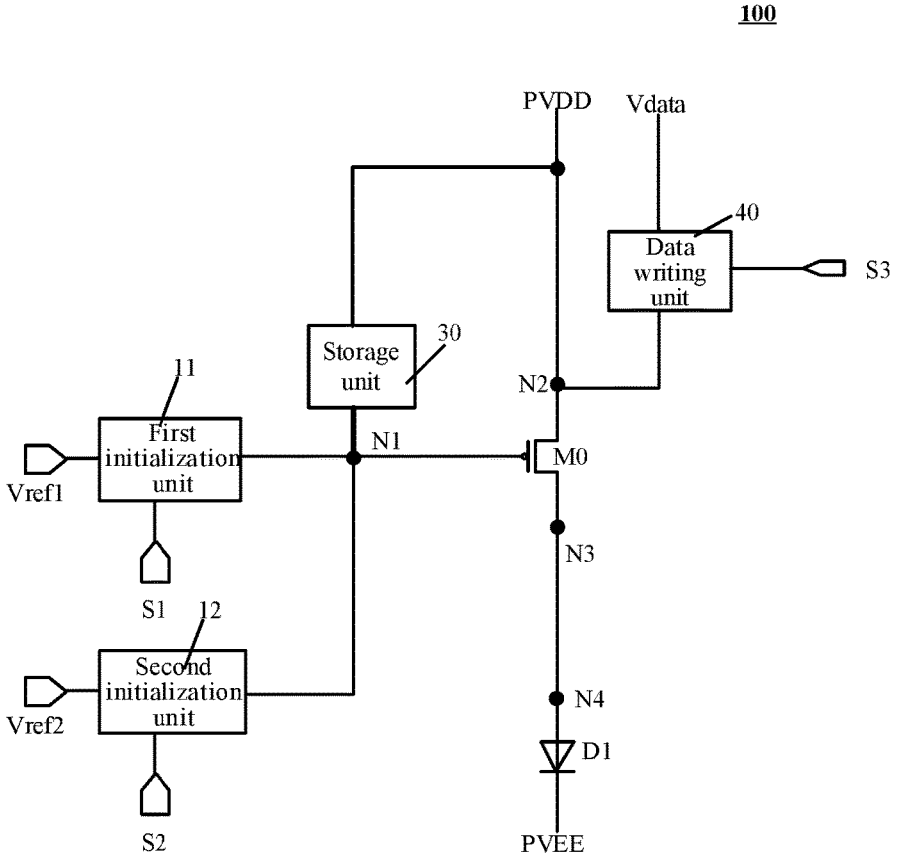
FIG. 3 illustrates a schematic diagram of a frame structure of an exemplary pixel driving circuit consistent with disclosed embodiments of the present disclosure.

FIG. 3 illustrates a schematic diagram of a frame structure of a pixel driving circuit 100 consistent with disclosed embodiments of the present disclosure. Referring to FIG. 3, the present disclosure provides a pixel driving circuit 100. The pixel driving circuit 100 may include a first power signal terminal PVDD and a second power signal terminal PVEE. The pixel driving circuit 100 may also include a driving transistor M0. A gate electrode of the driving transistor M0 may be connected to a first node N1, a first end of the driving transistor M0 may be connected to a second node N2, and a second end of the driving transistor M0 may be connected to a third node N3. In addition, the pixel driving circuit 100 may include a light-emitting component D1 connected in series between a fourth node N4 and the second power signal terminal PVEE, and a storage unit 30. A first end of the storage unit 30 may be connected to a fixed potential, and a second end of the storage unit 30 may be electrically connected to the first node N1. Optionally, the storage unit 30 may be a storage capacitor, and the first end of the storage unit 30 may be connected to the first power signal terminal PVDD.

Further, the pixel driving circuit 100 may include a first initialization unit 11 and a second initialization unit 12. A first end of the first initialization unit 11 may be connected to the first node N1, a second end thereof may be connected to a first initialization signal terminal Vref1, and a control terminal thereof may be connected to a first control signal terminal S. A first end of the second initialization unit 12 may be connected to the first node N1, a second end thereof may be connected to a second initialization signal terminal Vref2, and a control terminal thereof may be connected to a second control signal terminal S2.

The pixel driving circuit 100 may be configured to operate in a first-frequency driving mode at a first frequency and a second-frequency driving mode at a second frequency, where the first frequency may be less than the second frequency.

In the first-frequency driving mode: in the initialization stage, the first initialization unit 11 may be turned on for conduction, the second initialization unit 12 may be turned off (or cut off), and a voltage signal at the first initialization signal terminal Vref1 may be transmitted to the first node N1.

In the second-frequency driving mode: in the initialization stage, the second initialization unit 12 may be turned on, the first initialization unit 11 may be turned off, and the voltage signal at the second initialization signal terminal Vref2 may be transmitted to the first node N1. In a time-length of one frame (or in a same timeframe), the polarities of the voltage signals at the first initialization signal terminal Vref1 and the second initialization signal terminal Vref2 may be opposite. In the light-emitting stage, the first initialization unit 11 and the second initialization unit 12 both may be turned off.

It should be noted that FIG. 3 merely illustrates one frame structure of the pixel driving circuit 100 in the present disclosure. In certain embodiments of the present disclosure, the pixel driving circuit 100 may have any other frame structure, which is not limited by the present disclosure.

Referring to FIG. 3, the pixel driving circuit 100 may at least include a non-light-emitting stage and a light-emitting stage. In the non-light-emitting stage, the pixel driving circuit 100 may perform pre-light-emitting preparation work. In one embodiment, the non-light-emitting stage may include an initialization stage. The pixel driving circuit 100 in the present disclosure may include the first initialization unit 11 and the second initialization unit 12. The first ends of the first initialization unit 11 and the second initialization unit 12 both may be connected to the first node N1. In the initialization stage in the first-frequency driving mode, the first initialization unit 11 may be turned on, the second initialization unit 12 may be turned off, and the voltage signal of the first initialization signal terminal Vref1 may be transmitted to the first node N1 to initialize the driving transistor M0. In the initialization stage in the second-frequency driving mode, the second initialization unit 12 may be turned on, the first initialization unit 11 may be turned off, and the voltage signal of the second initialization signal terminal Vref2 may be transmitted to the first node N1 to initialize the driving transistor M0.

In another embodiment, the non-light-emitting stage may further include a data writing stage. The pixel driving circuit 100 may further include a data writing unit 40. A control terminal of the data writing unit 40 may be connected to a control signal terminal, a first end thereof may be connected to a data signal terminal Vdata, and a second end thereof may be connected to the second node N2 of the driving transistor M0. In the data writing stage, the control signal terminal may control the data writing unit 40 to be turned on, and the data signal terminal Vdata may transmit the data signal to the second node N2.

The present disclosure merely uses the initialization stage and the data writing stage as examples to describe the non-light-emitting stage, which are not intended to limit the non-light-emitting stage. In the light-emitting stage, the driving current of the driving transistor M0 may be transmitted to the light-emitting component D1, such that the light-emitting component D1 may emit light.

Figure 4:
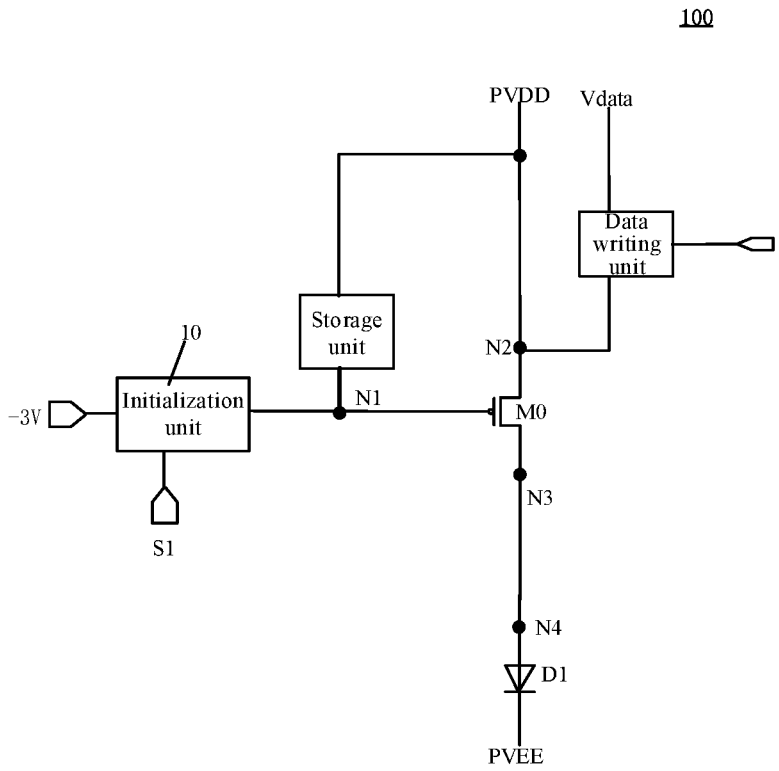
FIG. 4 illustrates a schematic structural diagram of a pixel driving circuit in the existing technology.

FIG. 4 illustrates a schematic structural diagram of a pixel driving circuit in the existing technology. Referring to FIG. 4, in the existing technology, the pixel driving circuit 100 usually includes merely one initialization unit 10. Assuming that a driving transistor M0 is a P-type transistor, a first end of the initialization unit is connected to a first node N1, and a second end thereof is connected to a negative voltage signal, e.g., −3V. In the initialization stage, the initialization unit is turned on, and the voltage signal of −3V is transmitted to the first node N1 to initialize the driving transistor M0. In the data writing stage, a data signal is written into a second node N2 through a data writing unit, and then through the driving transistor M0, is written into the first node N1 from the third node N3, such that the potential of the first node N1 is raised, assuming reaching 2V. In the light-emitting stage, the initialization unit is turned off. Due to the leakage current of the initialization unit, the potential signal of −3V connected to the initialization unit will gradually act on the first node N1, thereby lowering the potential of the first node N1, causing the potential of the first node N1 to gradually decrease from 2V.

In the driving mode at low frequencies, the number of refreshing pixels in the display device within a time-length of one frame is substantially small, which causes a substantially long time-length for the potential signal of −3V to act on the first node N1, and substantially seriously pulls down the potential of the first node N1. Therefore, the brightness of the light-emitting component D1 gradually rises, which in turn causes the display device to have a substantially obvious bright and dark change in the driving mode at low frequencies, in other words, the flicker change becomes substantially obvious, which seriously affects the display effect of the display device.

Referring to FIG. 3, in the present disclosure, two initialization units, the first initialization unit 11 and the second initialization unit 12, may be introduced in the pixel driving circuit 100. Polarities of voltage signals at the first initialization signal terminal Vref1 of the first initialization unit 11 and the second initialization signal terminal Vref2 of the second initialization unit 12 may be opposite. When the voltage signal at the first initialization signal terminal Vref1 is −3V, the voltage signal of the second initialization signal terminal Vref2 may be a positive value, e.g., +3V. In the light-emitting stage, due to the leakage current, the potential signal of −3V and the potential signal of +3V may simultaneously act on the first node N1. Even if the potential signal of −3V pulls down the potential of the first node N1, the potential signal of +3V may increase the potential of the first node N1. Two potential signals with opposite polarities may simultaneously act on the first node N1, which may substantially well maintain the potential of the first node N1. In the driving mode at low frequencies, the phenomenon that the potential of the first node N1 is pulled down to cause the light-emitting component D1 to have obvious uneven brightness may be prevented, which may facilitate to reduce or eliminate the occurrence of the flicker phenomenon of the display device in the driving mode at low frequencies, thereby facilitating to improve the display effect of the display device.

Accordingly, in the disclosed pixel driving circuit 100 provided by the present disclosure, the first initialization unit 11 and the second initialization unit 12 may be introduced. During the light-emitting stage, the first initialization unit 11 and the second initialization unit 12 both may be turned off. The first initialization unit 11 and the second initialization unit 12 may have a leakage current, and the polarities of the voltage signals of the first initialization signal terminal Vref1 and the second initialization signal terminal Vref2 may be opposite. Therefore, among the leakage currents of the first initialization unit 11 and the second initialization unit 12 applied to the first the node N1, one may increase the potential of the first node N1, and another one may decrease the potential of the first node N1, which may substantially well compensate for the potential of the first node N1. Thus, the potential of the first node N1 may be substantially well maintained, which may reduce or eliminate the occurrence of flicker phenomenon of the display device, due to the decrease in the amplitude of the potential of the first node N1 and a substantially long time-length at decreased potential in the driving mode at low frequencies. This improves the display effect of the display device in the driving mode at low frequencies.

In an optional embodiment of the present disclosure, the first frequency is $f_1$, and the second frequency is $f_2$, where $f_1 \leq 50$ Hz, and 50 Hz$<f_2<$90 Hz.

In one embodiment, the second frequency $f_2$ with a substantially high frequency in the present disclosure may be greater than 50 Hz and less than 90 Hz. In other words, the normal display may be driven by the second frequency, and may be refreshed 51 times to 89 times within one second. The refresh frequency may be substantially high, and the screen display may be substantially smooth, which may facilitate to improve the display effect of the display device. The first frequency $f_1$ with a substantially low frequency in the present disclosure may be less than or equal to 50 Hz. In other words, a substantially low frequency may be used for display in the standby state. For example, when a watch in wearable devices merely needs to display the time, the first frequency with a substantially low frequency may be used for display, in this way, the number of operations within one second may be less, and the corresponding power consumption may be substantially low, which may facilitate to save the power consumption of the display device. The present disclosure may use two driving modes with different frequencies, which may facilitate to save power consumption of the display panel while being applied to different display needs.

In an optional embodiment of the present disclosure, the absolute values of the signal values of the voltage signals at the first initialization signal terminal Vref1 and the second initialization signal terminal Vref2 may be equal.

In one embodiment, in the light-emitting stage, due to the existence of leakage current, the first initialization signal terminal Vref1 and the second initialization signal terminal Vref2 may apply potential signals with opposite polarities to the first node N1, respectively. One of Vref1 and Vref2 may increase the potential of the first node N1, and another one of Vref1 and Vref2 may decrease the potential of the first node N1. In the present disclosure, the absolute values of the signal values of the voltage signals of the first initialization signal terminal Vref1 and the second initialization signal terminal Vref2 may be equal. For example, the voltage signal of one of Vref1 and Vref2 may be +4.3V, and the voltage signal of another one of Vref1 and Vref2 may be −4.3V. When the voltage signal of −4.3V acts on the first node N1 to pull down the potential of the first node N1, the voltage signal of +4.3V may substantially well compensate for such pull-down situation, such that the potential pull-up amplitude and the potential pull-down amplitude of the first initialization signal terminal Vref1 and the second initialization signal terminal Vref2 to the first node N1 may be balanced to a large extent. The potential of the first node N1 may be substantially well maintained, which may facilitate to improve the display effect of the display device in the driving mode at low frequencies.

Figure 5:
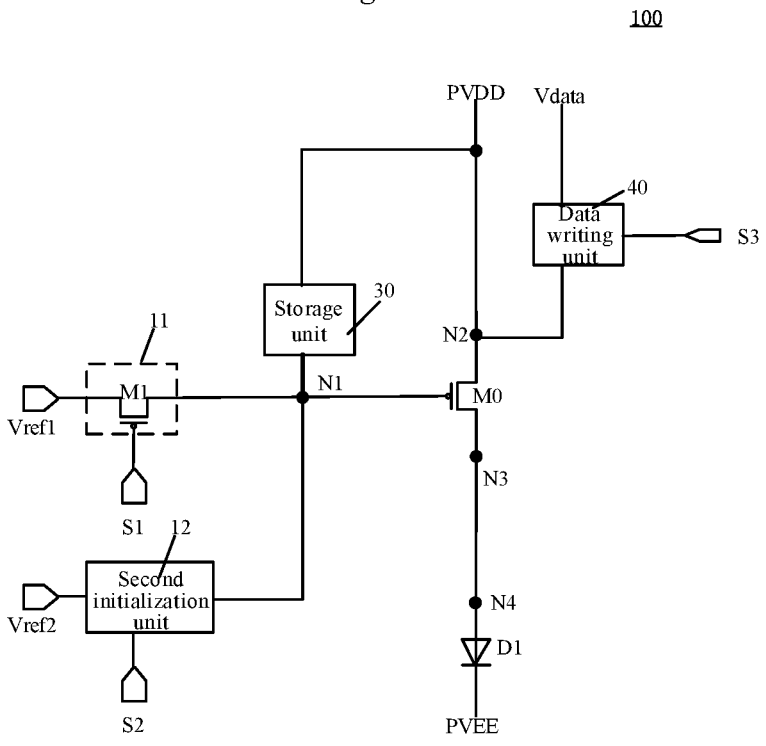
FIG. 5 illustrates a schematic diagram of a frame structure of another exemplary pixel driving circuit consistent with disclosed embodiments of the present disclosure.

FIG. 5 illustrates a schematic diagram of a frame structure of another pixel driving circuit 100 consistent with disclosed embodiments of the present disclosure. In an optional embodiment of the present disclosure, referring to FIG. 5, the first initialization unit 11 may include a first transistor M1. A gate electrode of the first transistor M1 may be connected to a first control signal terminal S, a first end thereof may be connected to the first node N1, and a second end thereof may be connected to the first initialization signal terminal Vref1. The first transistor M1 may be a P-type transistor. Under the first-frequency driving mode, in the initialization stage, the signal of the first initialization signal terminal Vref1 may be a negative value, and the signal of the second initialization signal terminal Vref2 may be a positive value.

Specifically, in the embodiment illustrated in FIG. 5, for illustrative purposes, the first transistor M1 in the first initialization unit 11 may be a P-type transistor, and the driving transistor M0 may be a P-type transistor as an example for description. The P-type transistor may be turned on under the control of a low-level signal, and may be turned off under the control of a high-level signal. In certain embodiments of the present disclosure, the first transistor M1 may be an N-type transistor, and the driving transistor M0 may be an N-type transistor. The N-type transistor may be turned on under the control of a high-level signal, and may be turned off under the control of a low-level signal, which is not specifically limited by the present disclosure. The first transistor M1 and the driving transistor M0 both being P-type transistors may be used as an example for description.

In the initialization stage of the driving mode at low frequencies (i.e., the first-frequency driving mode), the first transistor M1 may be turned on, and the signal at the first initialization signal terminal Vref1 may be transmitted to the driving transistor M0 through the first transistor M1 to initialize the driving transistor M0. Because the signal at the first initialization signal terminal Vref1 is a negative value, in this way, the potential of the first node N1 is a negative value. In the data writing stage, due to the writing of the signal, the potential of the first node N1 may be raised to a positive value. In the light-emitting stage, both the first transistor M1 and the second transistor M2 may be turned off. Due to the leakage current, the negative signal at the first initialization signal terminal Vref1 may act on the first node N1 through the first transistor M1, such that the potential of the first node N1 may be reduced. The positive signal at the second initialization signal terminal Vref2 may act on the first node N1 through the second initialization unit 12 to raise the potential of the second node N2. The first transistor M1 and the second initialization unit 12 may work together to substantially well maintain the potential of the first node N1, thereby the flicker phenomenon of the display device in the driving mode at low frequencies may be substantially well improved.

Figure 6:
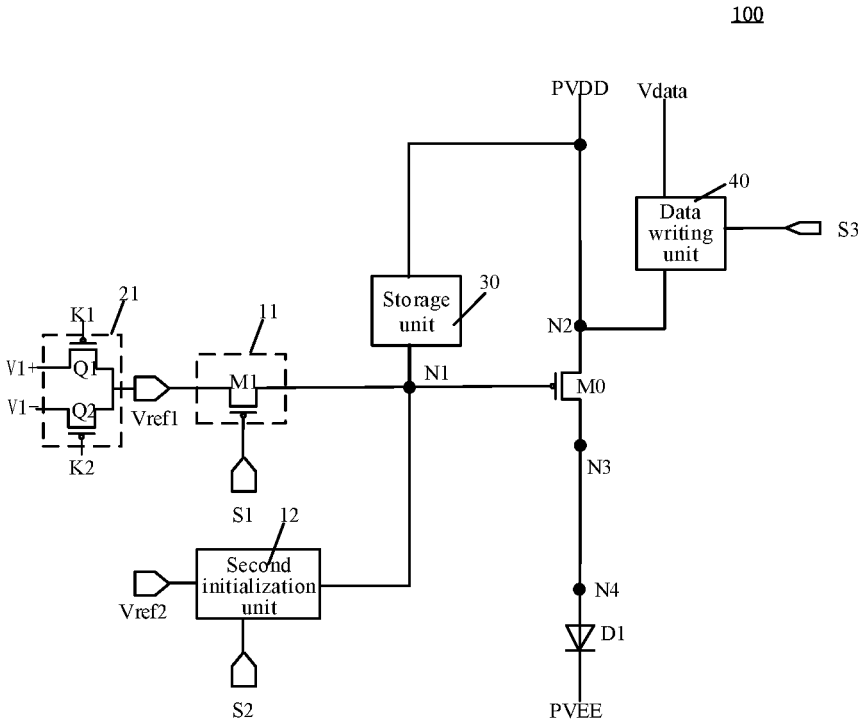
FIG. 6 illustrates a schematic diagram of a frame structure of another exemplary pixel driving circuit consistent with disclosed embodiments of the present disclosure.

FIG. 6 illustrates a schematic diagram of a frame structure of another pixel driving circuit 100 consistent with disclosed embodiments of the present disclosure. In an optional embodiment of the present disclosure, referring to FIG. 6, the pixel driving circuit 100 may further include a first switching unit 21 electrically connected to the first initialization signal terminal Vref1. The first switching unit 21 may include a first switching transistor Q1 and a second switching transistor Q2. The first ends of both the first switching transistor Q1 and the second switching transistor Q2 may be electrically connected to the first initialization signal terminal Vref1. A second end of the first switching transistor Q1 may be connected to a first positive voltage signal terminal V1+, and a second end of the second switching transistor Q2 may be connected to a first negative voltage signal terminal V1−. A control terminal of the first switching transistor Q1 may be connected to a first switch control signal terminal K1, and a control terminal of the second switching transistor Q2 may be connected to a second switch control signal terminal K2.

In one embodiment, referring to FIG. 6, the first initialization signal terminal Vref1 of the first initialization unit 11 provided by the present disclosure may be electrically connected to the first ends of both the first switching transistor Q1 and the second switching transistor Q2 in the first switching unit 21. The second end of the first switching transistor Q1 may be connected to the first positive voltage signal terminal V1+, and the second end of the second switching transistor Q2 may be connected to the first negative voltage signal terminal V1−. During the initialization stage in the first-frequency driving mode, the first switching transistor Q1 may be turned off, and the second switching transistor Q2 may be turned on. The negative voltage signal may be transmitted by the first negative voltage signal terminal V1− to the first initialization signal terminal Vref1 through the second switching transistor Q2, and then may be transmitted to the first node N1 through the first initialization signal terminal Vref1, such that the driving transistor M0 may be turned on to be initialized.

In the second-frequency driving mode, the first switching transistor Q1 may be turned on, and the second switching transistor Q2 may be turned off. The positive voltage signal may be transmitted by the first positive voltage signal terminal V1+ to the first initialization signal terminal Vref1 through the first switching transistor Q1. In the first-frequency driving mode and the second-frequency driving mode, the polarity of the signal at the first initialization signal terminal Vref1 may be opposite. In other words, in the first-frequency driving mode, the signal at the first initialization signal terminal may be a negative voltage signal; and in the second-frequency driving mode, the signal at the first initialization signal terminal may be a positive voltage signal. The first switching transistor Q1 and the second switching transistor Q2 may be introduced in the present disclosure, such that the polarity switching of the voltage signal at the first initialization signal terminal may be easily achieved by controlling the on and off of such two switching transistors.

It should be noted that the first switching transistor Q1 and the second switching transistor Q2 illustrated in FIG. 6 both may be P-type transistors. Because in the driving modes with different frequencies, the states of the first switching transistor Q1 and the second switching transistor Q2 may be opposite, in other words, one may be turned on and another one may be turned off. Therefore, the control terminals of the first switching transistor Q1 and the second switching transistor Q2 may be connected to different control signals.

Figure 7:
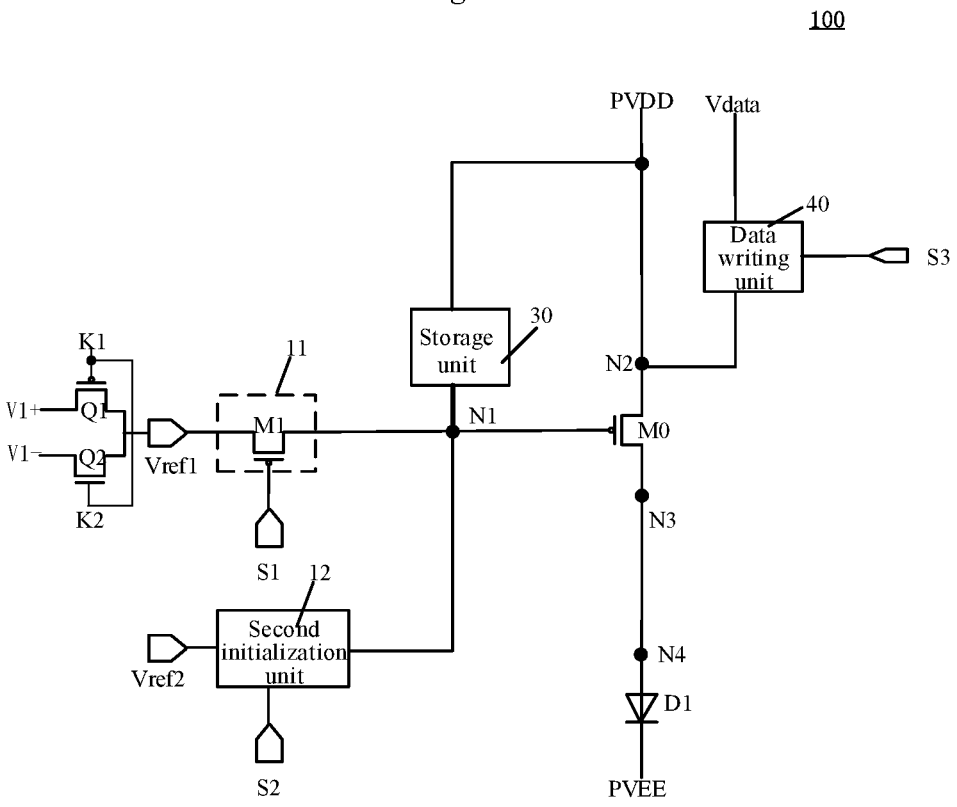
FIG. 7 illustrates a schematic diagram of a frame structure of another exemplary pixel driving circuit consistent with disclosed embodiments of the present disclosure.

FIG. 7 illustrates a schematic diagram of a frame structure of another pixel driving circuit 100 consistent with disclosed embodiments of the present disclosure. In an optional embodiment of the present disclosure, referring to FIG. 7, one of the first switching transistor Q1 and the second switching transistor Q2 may be a P-type transistor, and another one may be an N-type transistor, and the second switch control signal terminal K2 may multiplex the first switch control signal terminal K1.

In one embodiment, referring to FIG. 7, when the types of the first switching transistor Q1 and the second switching transistor Q2 are set to be different, a same control signal may control one of the first switching transistor Q1 and the second switching transistor Q2 to be turned on, and another one to be turned off. Therefore, the first switching transistor Q1 and the second switching transistor Q2 may share the same control signal terminal. In other words, in the present disclosure, the second switch control signal terminal K2 may multiplex the first switch control signal terminal K1, such setting may facilitate to reduce a quantity of control signal terminals required in the pixel driving circuit 100.

Figure 8:
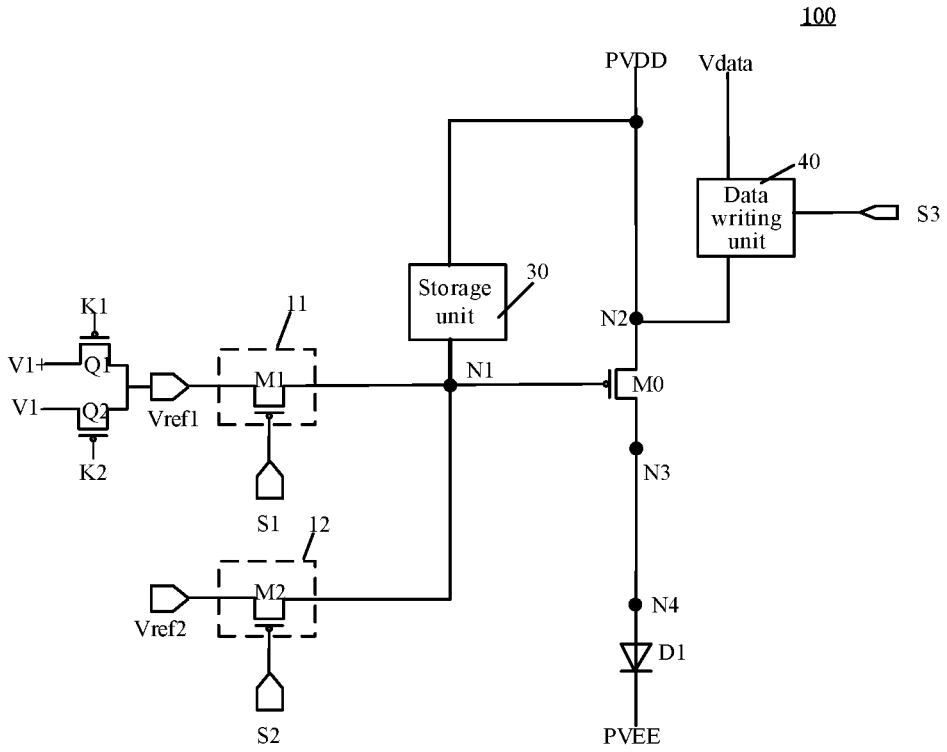
FIG. 8 illustrates a schematic diagram of a frame structure of another exemplary pixel driving circuit consistent with disclosed embodiments of the present disclosure.

FIG. 8 illustrates a schematic diagram of a frame structure of another pixel driving circuit 100 consistent with disclosed embodiments of the present disclosure. In an optional embodiment of the present disclosure, referring to FIG. 8, the second initialization unit 12 may include the second transistor M2. The gate electrode of the second transistor M2 may be connected to a second control signal terminal S2, the first end thereof may be connected to the first node N1, and the second end thereof may be connected to the second initialization signal terminal Vref2. The second transistor M2 may be a P-type transistor. In the second-frequency driving mode, in the initialization stage, the signal at the second initialization signal terminal Vref2 may be a negative value, and the signal at the first initialization signal terminal Vref1 may be a positive value.

For illustrative purposes, in the embodiment illustrated in FIG. 8, the second transistor M2 in the second initialization unit 12 may be a P-type transistor, and the driving transistor M0 may also be a P-type transistor as an example for description. The P-type transistor may be turned on under a control of a low-level signal, and may be turned off under a control of a high-level signal. In certain embodiments of the present disclosure, the second transistor M2 may be an N-type transistor, and the driving transistor M0 may be an N-type transistor. The P-type transistor may be turned on under a control of a high-level signal, and may be turned off under a control of a low-level signal. The second transistor M2 and the driving transistor M0 both being P-type transistors may be used as an example for description, which is not limited by the present disclosure.

In the initialization stage of a driving mode with a substantially high frequency (i.e., the second-frequency driving mode), the second transistor M2 may be turned on, and the signal at the second initialization signal terminal Vref2 may be transmitted to the driving transistor M0 through the second transistor M2 to initialize the driving transistor M0. Because the signal at the second initialization signal terminal Vref2 is a negative value, in this way, the potential of the first node N1 may be a negative value. In the data writing stage, due to the writing of the signal, the potential of the first node N1 may be raised to a positive value. In the light-emitting stage, both the first transistor M1 and the second transistor M2 may be turned off. Due to the leakage current, the negative signal at the second initialization signal terminal Vref2 may act on the first node N1 through the first transistor M1, such that the potential of the first node N1 may decrease. The positive signal at the first initialization signal terminal Vref1 may act on the first node N1 through the first initialization unit 11 to increase the potential of the first node N1. The second transistor M2 and the first initialization unit 11 may work together to substantially well maintain the potential of the first node N1, which may facilitate to improve the display effect of the display panel in the driving mode with a substantially high frequency.

Figure 9:
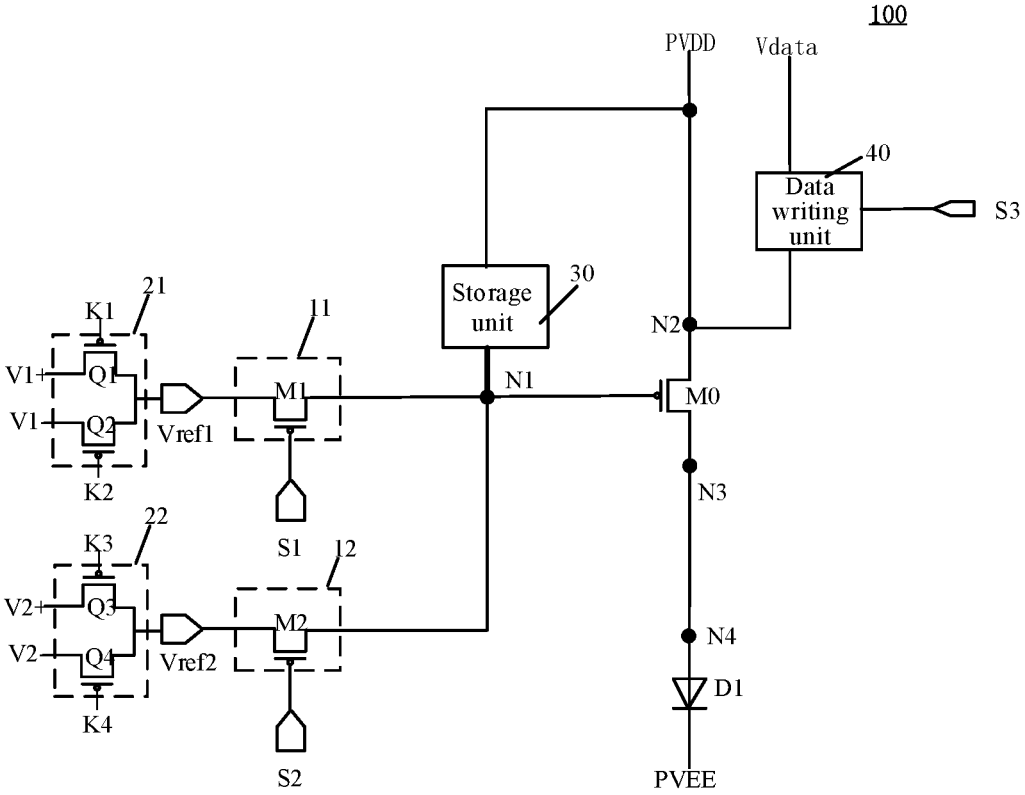
FIG. 9 illustrates a schematic diagram of a frame structure of another exemplary pixel driving circuit consistent with disclosed embodiments of the present disclosure.

FIG. 9 illustrates a schematic diagram of a frame structure of another pixel driving circuit 100 consistent with disclosed embodiments of the present disclosure. In an optional embodiment of the present disclosure, referring to FIG. 9, the pixel driving circuit 100 may further include a second switching unit 22 electrically connected to the second initialization signal terminal Vref2. The second switching unit 22 may include a third switching transistor Q3 and a fourth switching transistor Q4. First ends of the third switching transistor Q3 and the fourth switching transistor Q4 both may be electrically connected to the second initialization signal terminal Vref2. A second end of the third switching transistor Q3 may be connected to a second positive voltage signal terminal V2+, and a second end of the fourth switching transistor Q4 may be connected to the second negative voltage signal terminal V2−. A control terminal of the third switching transistor Q3 may be connected to a third switch control signal terminal K3, and a control terminal of the fourth switching transistor Q4 may be connected to a fourth switch control signal terminal K4.

In one embodiment, referring to FIG. 9, the second initialization signal terminal Vref2 of the second initialization unit 12 may be electrically connected to the first ends of the third switching transistor Q3 and the fourth switching transistor Q4 in the second switching unit 22. The second end of the third switching transistor Q3 may be connected to the second positive voltage signal terminal V2+, and the second end of the fourth switching transistor Q4 may be connected to the second negative voltage signal terminal V2−. In the initialization stage in the second-frequency driving mode, the third switching transistor Q3 may be turned off, and the fourth switching transistor Q4 may be turned on. The negative voltage signal may be transmitted by the second negative voltage signal terminal V2- to the second initialization signal terminal Vref2 through the fourth switching transistor Q4, and then may be transmitted to the first node N1 through the second initialization signal terminal Vref2, such that the driving transistor M0 may be turned on to be initialized.

In the first-frequency driving mode, the third switching transistor Q3 may be turned on, and the fourth switching transistor Q4 may be turned off. The positive voltage signal may be transmitted by the second positive voltage signal terminal V2+ to the second initialization signal terminal Vref2 through the third switching transistor Q3. In the first-frequency driving mode and the second-frequency driving mode, the polarity of the signal at the second initialization signal terminal Vref2 may be opposite. In other words, in the first-frequency driving mode, the signal at the second initialization signal terminal may be a positive voltage signal; and in the second-frequency driving mode, the signal at the second initialization signal terminal may be a negative voltage signal. In the present disclosure, the third switching transistor Q3 and the fourth switching transistor Q4 may be introduced, such that the polarity switching of the voltage signal at the second initialization signal terminal may be easily achieved by controlling the on and off of the such two switching transistors.

It should be noted that the third switching transistor Q3 and the fourth switching transistor Q4 illustrated in FIG. 9 both may be P-type transistors. Because in the driving modes with different frequencies, the states of the third switching transistor Q3 and the fourth switching transistor Q4 may be opposite, in other words, one may be turned on and another one may be turned off. Therefore, the control terminals of the third switching transistor Q3 and the fourth switching transistor Q4 may be connected to different control signals.

Figure 10:
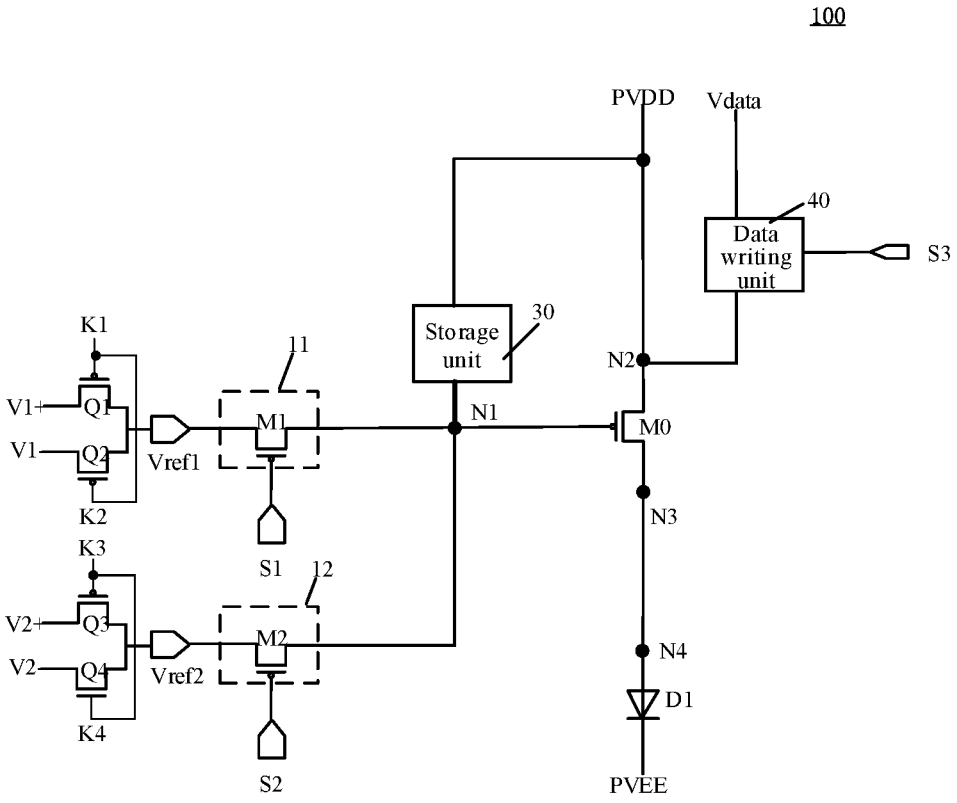
FIG. 10 illustrates a schematic diagram of a frame structure of another exemplary pixel driving circuit consistent with disclosed embodiments of the present disclosure.

FIG. 10 illustrates a schematic diagram of a frame structure of another pixel driving circuit 100 consistent with disclosed embodiments of the present disclosure. In an optional embodiment of the present disclosure, referring to FIG. 10, one of the third switching transistor Q3 and the fourth switching transistor Q4 may be a P-type transistor, and another one may be an N-type transistor, and the fourth switch control signal terminal K4 may multiplex the third switch control signal terminal K3.

In one embodiment, referring to FIG. 10, when the types of the third switching transistor Q3 and the fourth switching transistor Q4 are set to be different, a same control signal may control one of the third switching transistor Q3 and the fourth switching transistor Q4 to be turned on, and another one to be turned off. Therefore, the third switching transistor Q3 and the fourth switching transistor Q4 may share the same control signal terminal. In other words, in the present disclosure, the fourth switch control signal terminal K4 may multiplex the third switch control signal terminal K3, such setting may facilitate to reduce a quantity of control signal terminals required in the pixel driving circuit 100.

Figure 11:
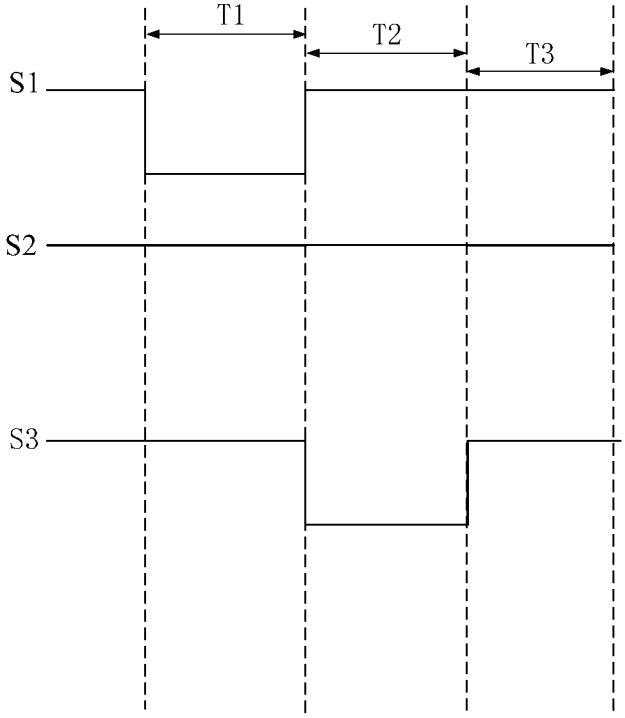
FIG. 11 illustrates a timing sequence diagram of an exemplary pixel driving circuit in a first-frequency driving mode consistent with disclosed embodiments of the present disclosure.
Figure 12:
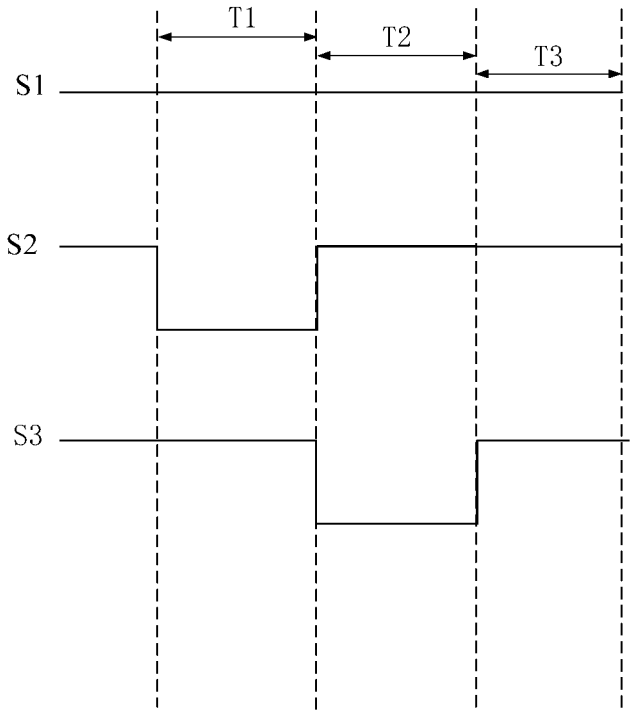
FIG. 12 illustrates a timing sequence diagram of an exemplary pixel driving circuit in a second-frequency driving mode consistent with disclosed embodiments of the present disclosure.

FIG. 11 illustrates a timing sequence diagram of a pixel driving circuit 100 in a first-frequency driving mode consistent with disclosed embodiments of the present disclosure; and FIG. 12 illustrates a timing sequence diagram of a pixel driving circuit 100 in a second-frequency driving mode consistent with disclosed embodiments of the present disclosure. A portion of the working process of the pixel driving circuit 100 illustrated in FIG. 9 may be described below with reference to the timing sequence diagrams illustrated in FIG. 11 and FIG. 12.

Referring to FIG. 11, in the first-frequency driving mode: in the initialization stage T1, the signal corresponding to the first control signal terminal S1 may be a low-level, and the signals corresponding to the second control signal terminal S2 and the third control signal terminal S3 may be a high-level. The signal corresponding to the first initialization signal terminal Vref1 may be a negative value, and the signal corresponding to the second initialization signal terminal Vref2 may be a positive value. In this way, the first initialization unit 11 may be turned on, and the negative voltage signal corresponding to the first initialization signal terminal Vref1 may be transmitted to the first node N1 through the first initialization unit 11. In the data writing stage T2, S1 and S2 both may be a high-level, and the first initialization unit 11 and the second initialization unit 12 both may be turned off. S3 may be a low-level. The data writing unit 40 may be turned on, the data signal may be written into the second node N2 through the data writing unit 40, and then may be written into the first node N1 from the third node N3 through the driving transistor M0, to raise the potential of the first node N1. In the light-emitting stage T3, S1, S2, and S3 all may be a high-level. Due to the leakage currents of the first initialization unit 11 and the second initialization unit 12, the negative signal corresponding to Vref1 and the positive signal corresponding to Vref2 may together act on the first node N1.

Referring to FIG. 12, in the second-frequency driving mode, in the initialization stage T1, S1 and S3 may be a high-level, S2 may be a low-level, Vref1 may be a positive value, and Vref2 may be a negative value. In this way, the second initialization unit 12 may be turned on, and the negative voltage signal corresponding to Vref2 may be transmitted to the first node N1 through the second initialization unit 12. In the data writing stage T2, S1 and S2 both may be a high-level, the first initialization unit 11 and the second initialization unit 12 both may be turned off, and S3 may be a low-level. The data writing unit 40 may be turned on, and the data signal may be written into the second node N2 through the data writing unit 40, and then may be written into the first node N1 from the third node N3 through the driving transistor M0, to raise the potential of the first node N1. In the light-emitting stage T3, S, S2, and S3 all may be a high-level. Due to the leakage currents of the first initialization unit 11 and the second initialization unit 12, the positive signal corresponding to Vref1 and the negative signal corresponding to Vref2 may together act on the first node N1. In an optional embodiment of the present disclosure, in the first-frequency driving mode or the second-frequency driving mode, in the initialization stage, one of the first initialization signal terminal Vref1 and the second initialization signal terminal Vref2 may be a positive value $V_{ref\text{-}positive}$, another one may be a negative value $V_{ref\text{-}negative}$, and the voltage value of the first node N1 may be $V_0$, where:

$$(V_{ref\text{-}positive} - V_0)\times\left(\frac{1}{f_2}\times\frac{W_1}{L_1}+\frac{1}{f_1}\times\frac{W_2}{L_2}\right)=(V_0 - V_{ref\text{-}negative})\times\left(\frac{1}{f_1}\times\frac{W_1}{L_1}+\frac{1}{f_2}\times\frac{W_2}{L_2}\right),$$

$W_1$ is a width of the channel of the first transistor M1, $L_1$ is a length of the channel of the first transistor M1, $W_2$ is a width of the channel of the second transistor M2, and $L_2$ is a length of the channel of the second transistor M2.

In one embodiment, in the first-frequency driving mode and the second-frequency driving mode, both the first frequency and the second frequency may be known, and the width-to-length ratio of the channel of the first transistor M1 and the width-to-length ratio of the channel of the second transistor M2 may be a fixed value. By adjusting the voltage value $V_{ref\text{-}positive}$ of one of the first initialization signal terminal Vref1 and the second initialization signal terminal Vref2, the voltage value $V_{ref\text{-}negative}$ of another one, and the voltage value $V_0$ of the first node N1, the relationship between the three may be set to satisfy the above formula, which may facilitate to ensure that the display brightness in the first-frequency driving mode is the same as the display brightness in the second-frequency driving mode. Therefore, the occurrence of the flicker phenomenon of the display screen in the driving mode at low frequencies may be reduced, the difference in display brightness of the display screen under driving modes with different frequencies may be reduced, thereby facilitating to improve the display effect of the display panel.

In an optional embodiment of the present disclosure, the width-to-length ratio of the first transistor M1 may be $A_1$, where $A_1=W_1/L_1$; the width-to-length ratio of the second transistor M2 may be $A_2$, where $A_2=W_2/L_2$; and $A_1$ may be less than $A_2$.

In one embodiment, considering that the width-to-length ratio of the transistor may be related to the leakage current thereof, the smaller the value of the width-to-length ratio, the smaller the corresponding leakage current. Referring to FIG. 10, because the first transistor M1 is turned on in the driving mode at low frequencies, in the initialization stage, the negative voltage signal corresponding to the first initialization signal terminal Vref1 may be provided to the first node N. In the light-emitting stage, the negative voltage signal corresponding to the first initialization signal terminal Vref1 may act on the first node N1 to pull down the potential of the first node N1, causing the brightness of the light-emitting component D1 to become substantially bright.

In the present disclosure, the width-to-length ratio of the first transistor M1 may be set to be less than the width-to-length ratio of the second transistor M2, such that the leakage current corresponding to the first transistor M1 may decrease. Therefore, in the driving mode at low frequencies, the intensity of the negative voltage signal acting on the first node N1 through the first transistor M1 may decrease, and the magnitude to which the potential of the first node N1 is pulled down may decrease accordingly. When the width-to-length ratio of the second transistor M2 is set to be substantially large, the leakage current of the second transistor M2 may be substantially large, and the intensity of the positive voltage signal acting on the first node N1 through the second transistor M2 may increase. Therefore, the compensation effect on the potential of the first node N1 may be substantially obvious, which may facilitate to reduce or eliminate the flicker phenomenon of the light-emitting component D1 in the driving mode at low frequencies.

In another embodiment, to enable the width-to-length ratio of the first transistor M1 to be less than the width-to-length ratio of the second transistor M2, the length or width of the channels of the first transistor M1 and the second transistor M2 may be changed, for example $L_1>L_2$, or $W_1<W_2$, or, simultaneously satisfying both $L_1>L_2$ and $W_1<W_2$, which is not limited by the present disclosure.

Figure 13:
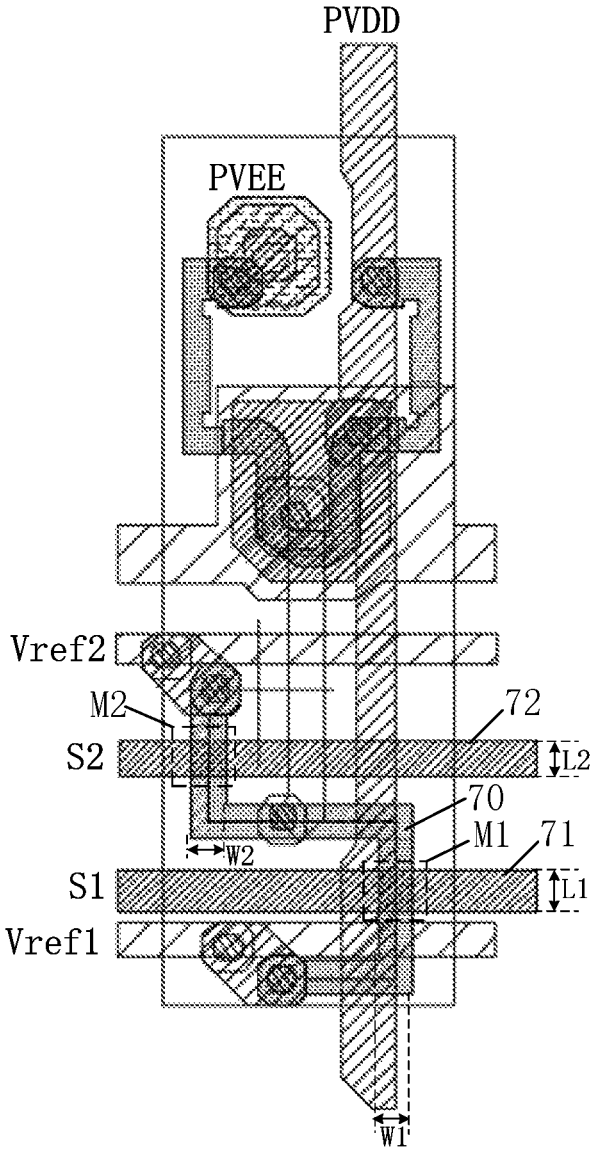
FIG. 13 illustrates a layout diagram of a first transistor and a second transistor consistent with disclosed embodiments of the present disclosure.
Figure 14:
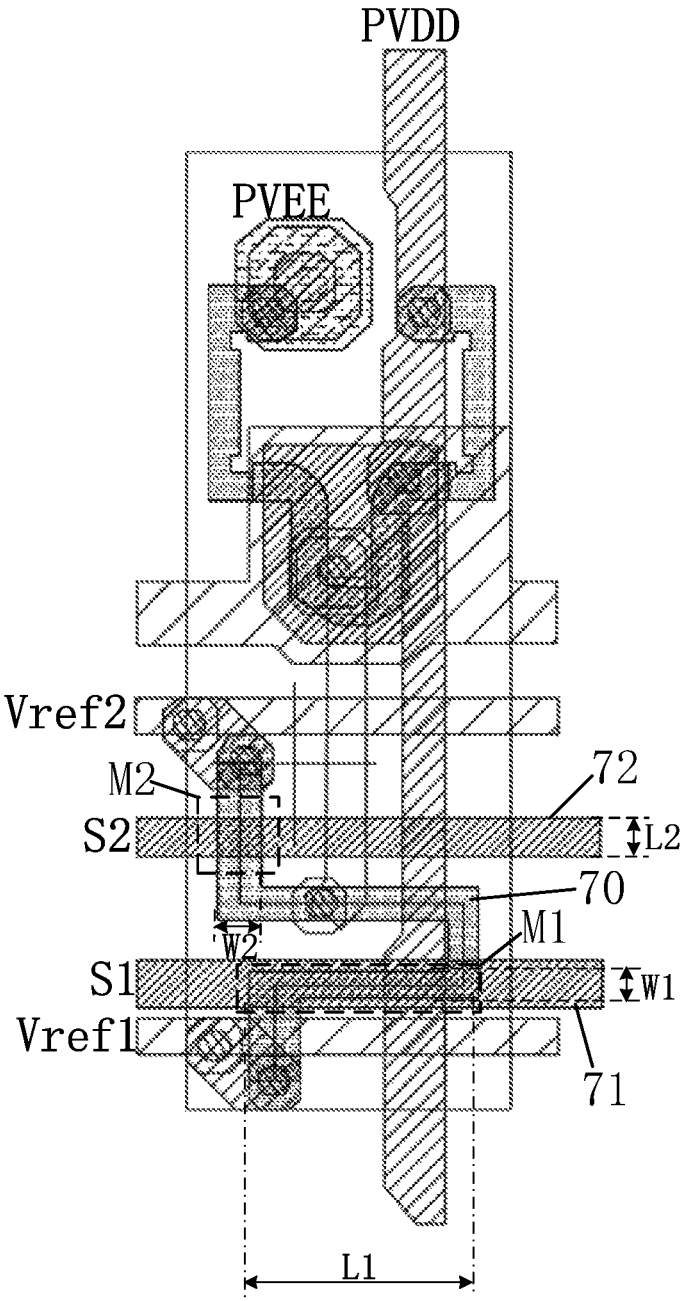
FIG. 14 illustrates another layout diagram of a first transistor and a second transistor consistent with disclosed embodiments of the present disclosure.
Figure 15:
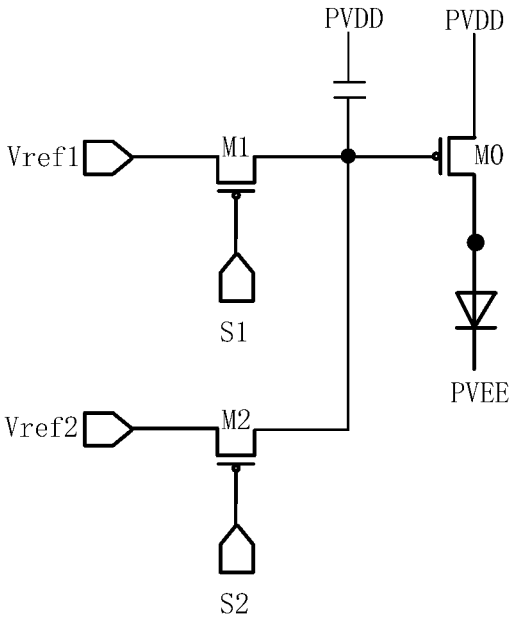
FIG. 15 illustrates a schematic circuit structure diagram corresponding to the layout diagrams illustrated in FIG. 13 and FIG. 14 consistent with disclosed embodiments of the present disclosure.

FIG. 13 illustrates a layout diagram of the first transistor M1 and the second transistor M2 consistent with disclosed embodiments of the present disclosure; FIG. 14 illustrates another layout diagram of the first transistor and the second transistor consistent with disclosed embodiments of the present disclosure; and FIG. 15 illustrates a schematic circuit structure diagram corresponding to the layout diagrams illustrated in FIG. 13 and FIG. 14 consistent with disclosed embodiments of the present disclosure. The circuit structure diagram may embody a partial structure of the pixel driving circuit in the present disclosure. For illustrative purposes, the circuit diagram may use the first initialization unit being the first transistor M1 and the second initialization unit being the second transistor M2 as an example for description.

Referring to FIG. 13 and FIG. 14, the first transistor M1 may correspond to an overlapped region between the metal 71 and the active layer 70. The channel length $L_1$ of the first transistor M1 may refer to the dimension of the overlapped region in the extending direction of the active layer 70, and the channel width $W_1$ of the first transistor M1 may refer to the width of the active layer 70. Similarly, the second transistor M2 may correspond to an overlapped region between the metal 72 and the active layer 70. The channel length $L_2$ of the second transistor M2 may refer to the dimension of the overlapped region in the extending direction of the active layer 70, and the channel width $W_2$ of the second transistor M2 may refer to the width of the active layer 70. The circuit diagram in FIG. 15 may correspond to the design layouts in FIG. 13 and FIG. 14. The specific positions of the first initialization signal terminal Vref1, the second initialization signal terminal Vref2, the first control signal terminal S1, the second control signal terminal S2, the first power signal terminal PVDD, and the second power signal terminal PVEE may be marked in the design layouts in FIG. 13 and FIG. 14 accordingly.

In the embodiment illustrated in FIG. 13, the channel widths corresponding to the first transistor M1 and the second transistor M2 may be consistent, i.e., $W_1=W_2$. Because the width of the metal 71 is greater than the width of the metal 72, the channel length $L_1$ corresponding to the first transistor M1 may be larger than the channel length $L_2$ corresponding to the second transistor M2, thereby achieving the width-to-length ratio of the first transistor M1 being less than the width-to-length ratio of the second transistor M2.

In the embodiment illustrated in FIG. 14, the channel widths corresponding to the first transistor M1 and the second transistor M2 may be consistent, i.e., $W=W_2$. Along the extending direction of the active layer 70, the overlapped region between the metal 71 and the active layer 70 may be substantially large. Therefore, the channel length $L_1$ corresponding to the first transistor M1 may be larger than the channel length $L_2$ corresponding to the second transistor M2, thereby achieving the width-to-length ratio of the first transistor M1 being less than the width-to-length ratio of the second transistor M2.

In an optional embodiment of the present disclosure, $$A_2 = A_1 \times \frac{f_2}{f_1}.$$

In this way, the relationship between the width-to-length ratio of the first transistor M1 and the second transistor M2 may be set according to the actual driving frequency value. Then, the intensities of the leakage currents of the first transistor M1 and the second transistor M2 may be adjusted, which may facilitate to balance the intensities of the negative voltage signal and the positive voltage signal acting on the first node N1, to improve the display effect of the display panel in the driving mode at low frequencies.

Figure 16:
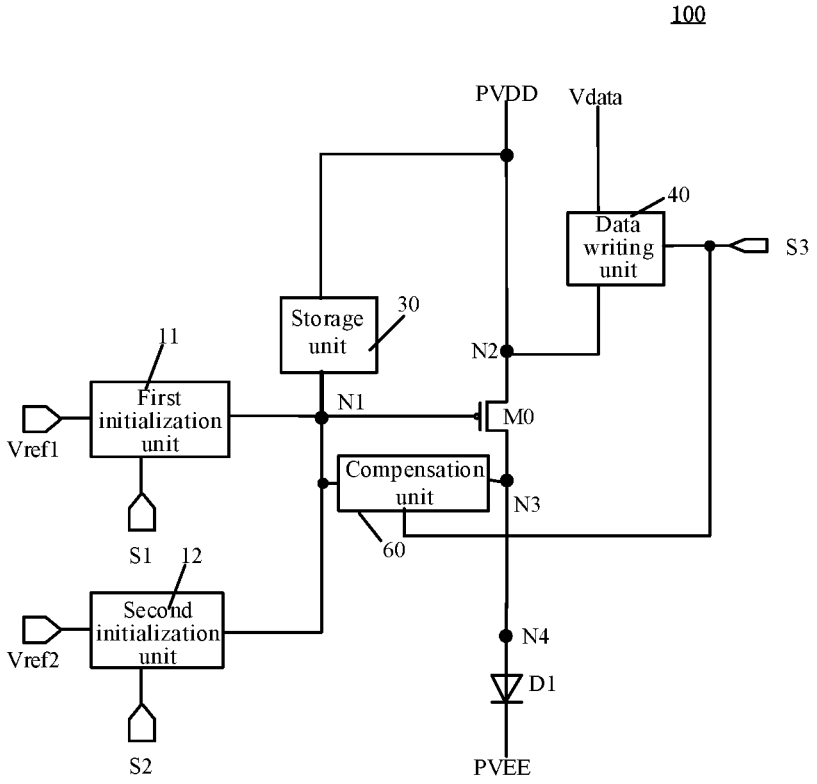
FIG. 16 illustrates a schematic diagram of a frame structure of another exemplary pixel driving circuit consistent with disclosed embodiments of the present disclosure.

FIG. 16 illustrates a schematic diagram of a frame structure of another pixel driving circuit 100 consistent with disclosed embodiments of the present disclosure. In an optional embodiment of the present disclosure, referring to FIG. 16, the pixel driving circuit 100 may further include a data writing unit 40 and a compensation unit 60. The first end of the data writing unit 40 may be connected to a data signal terminal Vdata, a second end thereof may be connected to the second node N2, the control terminal thereof may be connected to the third control signal terminal S3. A first end of the compensation unit 60 may be connected to the first node N1, a second end thereof may be connected to the third node N3, and the control terminal thereof may be connected to the third control signal terminal S3.

In the data writing stage, the data writing unit 40 and the compensation unit 60 may be turned on, and the data signal terminal Vdata may transmit the data signal to the second node N2. The signal of the second node N2 may be transmitted to the third node N3 through the driving transistor M0, and the signal of the third node N3 may be transmitted to the first node N1 through the compensation unit 60, such that the voltage value of the first node N1 may be $V_0$.

In the first-frequency driving mode, the voltage value of the second initialization signal terminal Vref2 may be V2, where $V_2>V_0$. In the second-frequency driving mode, the voltage value of the first initialization signal terminal Vref1 may be $V_3$, where $V_3>V_0$.

In one embodiment, referring to FIG. 16, in the first-frequency driving mode, due to the leakage currents of the first initialization unit 11 and the second initialization unit 12, in the light-emitting stage, the negative voltage signal of the first initialization signal terminal Vref1 may act on the first node N1 to pull down the voltage value of the first node N1 to be below $V_0$. In the present disclosure, when the positive voltage value V2 of the second initialization signal terminal Vref2 is set to be greater than $V_0$, in the light-emitting stage, the positive voltage value V2 of the second initialization signal terminal Vref2 may have enough space to increase the voltage value of the first node N1, so as to substantially well compensate for the voltage value of the first node N1, which may facilitate to improve the display effect of the display device in the driving mode at low frequencies. Similarly, in the second-frequency driving mode, the voltage value of the first initialization signal terminal Vref1 may be set to be greater than the voltage value of the first node N1, which may substantially well compensate for the voltage value of the first node N1.

Figure 17:
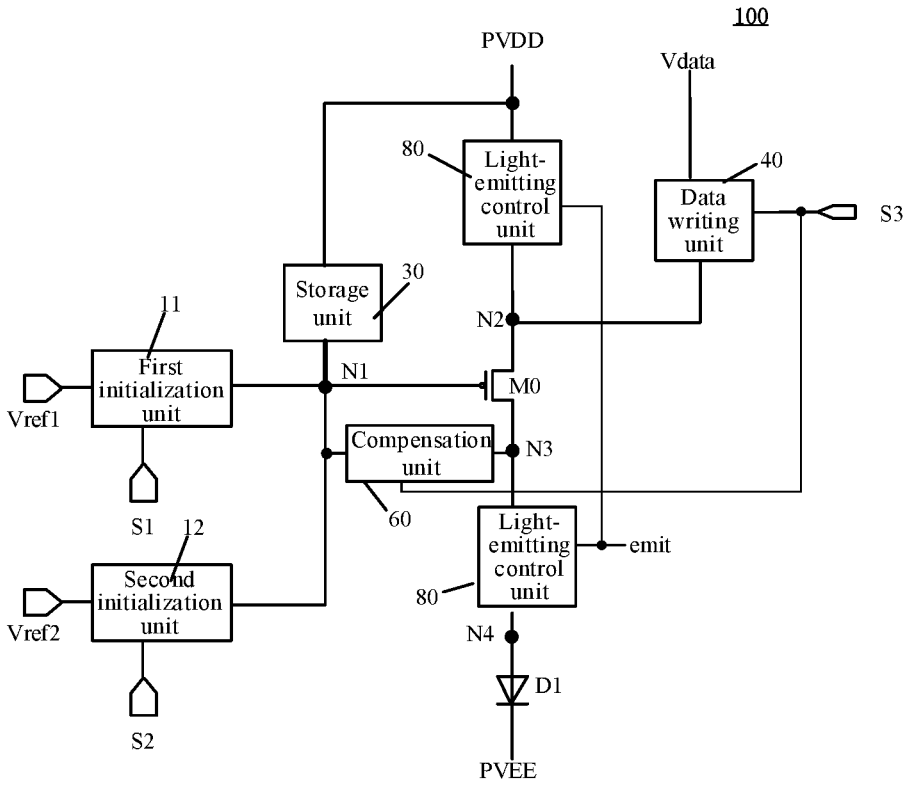
FIG. 17 illustrates a schematic diagram of a frame structure of another exemplary pixel driving circuit consistent with disclosed embodiments of the present disclosure.

FIG. 17 illustrates a schematic diagram of a frame structure of another pixel driving circuit 100 consistent with disclosed embodiments of the present disclosure. In an optional embodiment of the present disclosure, referring to FIG. 17, the pixel driving circuit 100 may further include a light-emitting control unit 80. The light-emitting control unit 80, the driving transistor M0, and the light-emitting component D1 may be connected in series between the first power signal terminal PVDD and the second power signal terminal PVEE. The light-emitting control unit 80 may be electrically connected to the light-emitting control signal terminal 'emit' through a light-emitting control line.

The light-emitting control signal terminal 'emit' may receive the light-emitting control signal, and may transmit the light-emitting control signal to the light-emitting control unit 80 through the light-emitting control line, to enable the light-emitting control unit 80 to be turned on. The first initialization unit 11 and the second initialization unit 12 may generate leakage currents with opposite polarities, respectively, and may respectively transmit the leakage currents to the first node N1, and the driving transistor M0 may generate a driving current and transmit the driving current to the light-emitting component D1.

In one embodiment, referring to FIG. 17, in the present disclosure, a light-emitting control unit 80 may be introduced in the pixel driving circuit 100. In the light-emitting stage, the light-emitting control unit 80 may be turned on, and the driving transistor M0 may generate a driving current and transmit the driving current to the light-emitting component D1. In particular, in the light-emitting stage, due to the leakage currents of the first initialization unit 11 and the second initialization unit 12, the leakage currents with opposite polarities generated by the first initialization unit 11 and the second initialization unit 12 may respectively act on the first node N1, even if one of them may lower the potential of the first node N1, another one may raise the potential of the first node N1, such that the potential of the first node N1 may be substantially well maintained, which may facilitate to reduce or eliminate the flicker phenomenon of the display device in the driving mode at low frequencies.

Figure 18:
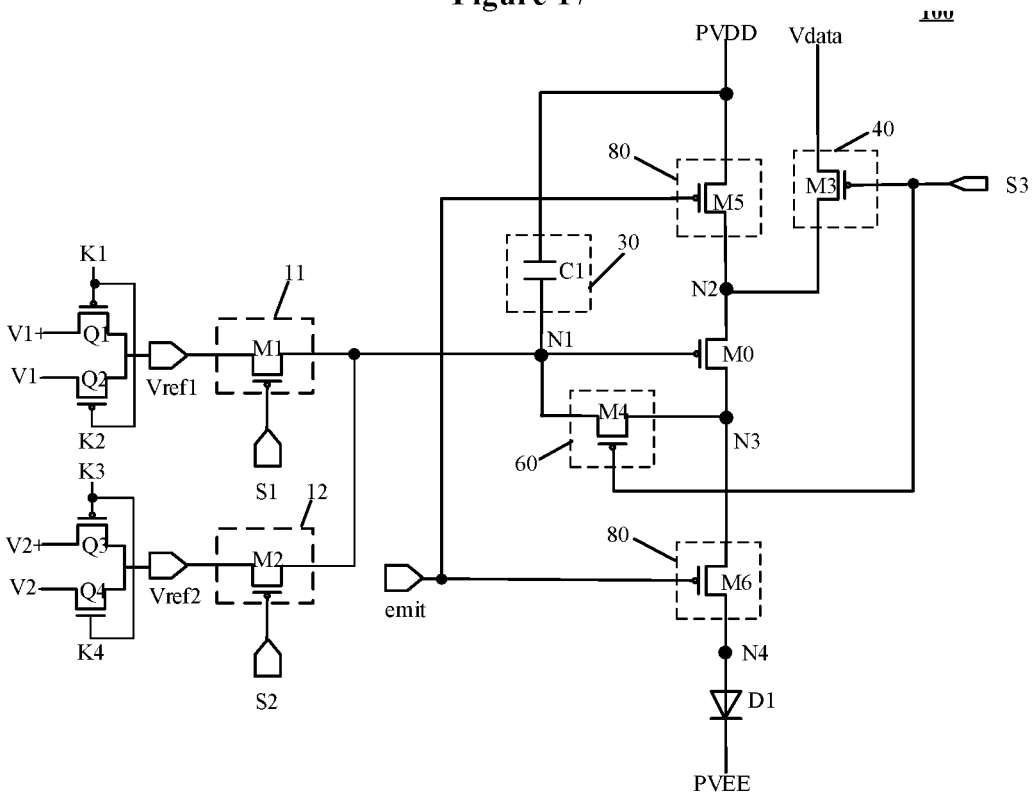
FIG. 18 illustrates a schematic circuit diagram of an exemplary pixel driving circuit consistent with disclosed embodiments of the present disclosure.

FIG. 18 illustrates a schematic circuit diagram of a pixel driving circuit consistent with disclosed embodiments of the present disclosure. Referring to FIG. 18, the first initialization unit may be embodied as the first transistor M1, the second initialization unit may be embodied as the second transistor M2, the data writing unit may be embodied as a transistor M3, the compensation unit may be embodied as a transistor M4, and the light-emitting control unit may be embodied as transistors M5 and M6. For illustrative purposes, in the present embodiment, the transistors M1-M6 and the driving transistor M0 all may be P-type transistors as an example for description. The working process of the pixel driving circuit in the first-frequency driving mode may be described below with reference to the drawing.

In the initialization stage, the first transistor M1 may be turned on, and the second transistor M2 may be turned off. The first switching transistor Q1 may be turned off, and the second switching transistor Q2 may be turned on. The negative voltage signal may be transmitted by the first negative voltage signal terminal V1- to the first initialization signal terminal Vref1 through the second switching transistor Q2, and may be transmitted to the first node N1 from the first transistor M1, to initialize the driving transistor M0.

In the data writing stage, both the first transistor M1 and the second transistor M2 may be turned off, and the transistors M3 and M4 may be turned on. The data signal terminal Vdata may transmit the data signal to the second node N2. The signal of the second node N2 may be transmitted to the third node N3 through the driving transistor M0, and the signal of the third node N3 may be transmitted to the first node N1 through the transistor M4, such that the potential of the first node N1 may be raised.

In the light-emitting stage, the transistors M3 and M4 may be turned off, and the transistors M5 and M6 may be turned on. The driving current generated by the driving transistor may be transmitted to the light-emitting component D1 to enable the light-emitting component to emit light. Due to the leakage currents of the first transistor M1 and the second transistor M2, the negative voltage signal of the first initialization signal terminal Vref1 may act on the first node N1 to pull down the voltage value of the first node N1. The positive voltage signal of the second initialization signal terminal Vref2 may act on the first node N1, to raise the voltage value of the first node N1. Therefore, the potential of the first node N1 may be substantially well maintained, such that the driving current generated by the driving transistor may be substantially stable, which may facilitate to reduce or eliminate the flicker phenomenon of the display device in the driving mode at low frequencies.

The present disclosure also provides a driving method of the pixel driving circuit 100. Referring to FIG. 3, the method may include following.

In the first-frequency driving mode: in the initialization stage, the first control signal terminal S1 may send a first control signal to the first initialization unit 11, and the second control signal terminal S2 may send a second control signal to the second initialization signal terminal Vref2, such that the first initialization unit 11 may be turned on, the second initialization unit 12 may be turned off, and the first initialization signal terminal Vref1 may transmit the voltage signal to the first node N1.

In the second-frequency driving mode: in the initialization stage, the first control signal terminal S1 may send a third control signal to the first initialization unit 11, and the second control signal terminal S2 may send a fourth control signal to the second initialization signal terminal Vref2, such that the second initialization unit 12 may be turned on, the first initialization unit 11 may be turned off, and the second initialization signal terminal Vref2 may transmit the voltage signal to the first node N1.

In a time-length of one frame, polarities of the voltage signals at the first initialization signal terminal Vref1 and the second initialization signal terminal Vref2 may be opposite. In the light-emitting stage, the first initialization unit 11 and the second initialization unit 12 both may be turned off.

In one embodiment, referring to FIG. 3, the pixel driving circuit 100 may include at least a non-light-emitting stage and a light-emitting stage. In the non-light-emitting stage, the pixel driving circuit 100 may perform pre-light-emitting preparation work. For example, the non-light-emitting stage may include an initialization stage. In the present disclosure, the first ends of the first initialization unit 11 and the second initialization unit 12 in the pixel driving circuit 100 both may be connected to the first node N1. In the initialization stage in the first-frequency driving mode, the first initialization unit 11 may be turned on, the second initialization unit 12 may be turned off, and the voltage signal at the first initialization signal terminal Vref1 may be transmitted to the first node N1 to initialize the driving transistor M0. In the initialization stage in the second-frequency driving mode, the second initialization unit 12 may be turned on, the first initialization unit 11 may be turned off, and the voltage signal at the second initialization signal terminal Vref2 may be transmitted to the first node N1 to initialize the driving transistor M0.

In the present disclosure, two initialization units, the first initialization unit 11 and the second initialization unit 12, may be introduced into the pixel driving circuit 100. The polarities of the voltage signals at the first initialization signal terminal Vref1 of the first initialization unit 11 and the second initialization signal terminal Vref2 of the second initialization unit 12 may be opposite. When the voltage signal of the first initialization signal terminal Vref1 is −3V, the voltage signal of the second initialization signal terminal Vref2 may be a positive value, e.g., +3V. In the light-emitting stage, due to the presence of leakage currents, the potential signal of −3V and the potential signal of +3V may simultaneously act on the first node N1. Even if the potential signal of −3V pulls down the potential of the first node N1, the potential signal of +3V may raise the potential of the first node N1. The two potential signals with opposite polarities may simultaneously act on the first node N1, which may substantially well maintain the potential of the first node N1. In the driving mode at low frequencies, the phenomenon that the potential of the first node N1 is pulled down to cause the light-emitting component D1 to have obvious uneven brightness may be prevented, which may facilitate to reduce or eliminate the occurrence of the flicker phenomenon of the display device in the driving mode at low frequencies, thereby facilitating to improve the display effect of the display device.

In an optional embodiment of the present disclosure, referring to FIG. 16, the pixel driving circuit 100 may further include a data writing unit 40 and a compensation unit 60. The first end of the data writing unit 40 may be connected to a data signal terminal, the second end thereof may be connected to the second node N2, the control terminal may be connected to the third control signal terminal S3. A first end of the compensation unit 60 may be connected to the first node N1, a second end thereof may be connected to the third node N3, and the control terminal thereof may be connected to the third control signal terminal S3.

The driving method may further include a data writing stage. In the data writing stage, the third control signal terminal may control the data writing unit 40 and the compensation unit 60 to be turned on, and the data signal terminal Vdata may transmit the data signal to the second node N2. The signal of the second node N2 may be transmitted to the third node N3 through the driving transistor M0, and the signal of the third node N3 may be transmitted to the first node N1 through the compensation unit 60, such that the voltage value of the first node N1 may be $V_0$.

In the first-frequency driving mode, the voltage value of the second initialization signal terminal Vref2 may be $V_2$, where $V_2>V_0$. In the second-frequency driving mode, the voltage value of the first initialization signal terminal Vref1 may be $V_3$, where $V_3>V_0$.

In one embodiment, in the first-frequency driving mode, due to the leakage currents of the first initialization unit 11 and the second initialization unit 12, in the light-emitting stage, the negative voltage signal of the first initialization signal terminal Vref1 may act on the first node N1 to pull down the voltage value of the first node N1 to be below $V_0$. In the present disclosure, when the positive voltage value V2 of the second initialization signal terminal Vref2 is set to be greater than $V_0$, in the light-emitting stage, the positive voltage value V2 of the second initialization signal terminal Vref2 may have enough space to increase the voltage value of the first node N1, so as to substantially well compensate for the voltage value of the first node N1, which may facilitate to improve the display effect of the display device in the driving mode at low frequencies. Similarly, in the second-frequency driving mode, the voltage value of the first initialization signal terminal Vref1 may be set to be greater than the voltage value of the first node N1, which may substantially well compensate for the voltage value of the first node N1.

In an optional embodiment of the present disclosure, with reference to FIG. 17, in the light-emitting stage, the light-emitting control terminal may send the light-emitting control signal to the light-emitting control unit 80 to enable the light-emitting control unit 80 to be turned on. Under the action of the voltage signals of the first initialization signal terminal Vref1 and the second initialization signal terminal Vref2, the first initialization unit 11 and the second initialization unit 12 may generate leakage currents with opposite polarities and may transmit the leakage currents to the first node N1, respectively, such that the driving transistor M0 may generate a driving current and may transmit the driving current to the light-emitting component D1.

In one embodiment, in the present disclosure, the light-emitting control unit 80 may be introduced in the pixel driving circuit 100. In the light-emitting stage, the light-emitting control unit 80 may be turned on, and the driving transistor M0 may generate a driving current and transmit the driving current to the light-emitting component D1. In particular, in the light-emitting stage, due to the leakage currents of the first initialization unit 11 and the second initialization unit 12, the leakage currents with opposite polarities generated by the first initialization unit 11 and the second initialization unit 12 may respectively act on the first node N1, even if one of them may lower the potential of the first node N1, another one may raise the potential of the first node N1, such that the potential of the first node N1 may be substantially well maintained, which may facilitate to reduce or eliminate the flicker phenomenon of the display device in the driving mode at low frequencies.

Figure 19:
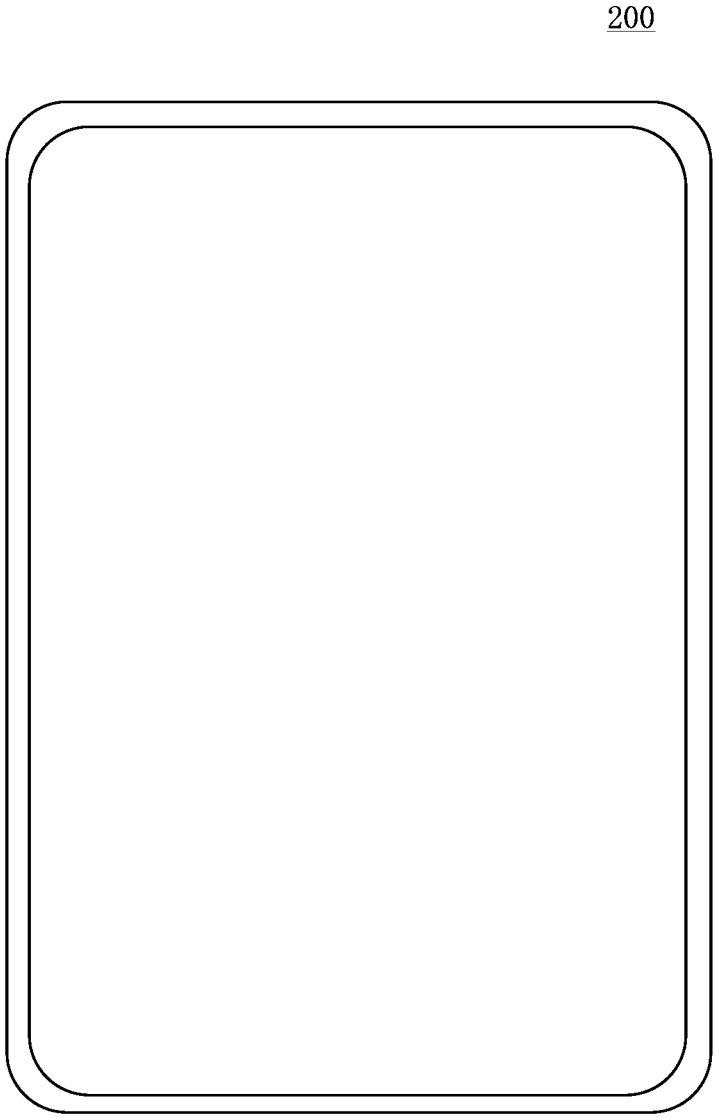
FIG. 19 illustrates a schematic structural diagram of an exemplary display device consistent with disclosed embodiments of the present disclosure.

The present disclosure also provides a display device. FIG. 19 illustrates a schematic structural diagram of a display device consistent with disclosed embodiments of the present disclosure. Referring to FIG. 19, the display device 200 may include the pixel driving circuit provided by any one of the above embodiments in the present disclosure. The display device in the present disclosure may include the pixel driving circuit provided by the above embodiments, which may facilitate to reduce or eliminate the flicker phenomenon of the display screen of the display device in the first-frequency driving mode, so as to improve the display effect of the display device.

It should be noted that, the embodiment of the display device 200 provided by the present disclosure may refer to the above-mentioned embodiment of the pixel driving circuit, which is not repeated herein. The display device 200 provided by the present disclosure may be any product or component having a display function, e.g., a mobile phone, a tablet computer, a television, a display, a notebook computer, a digital photo frame, a navigator, etc.

It should be noted that the display device provided by the present disclosure may be particularly suitable for electronic display products having low-frequency display requirements, e.g., a wearable device, a watch with a display screen.

Accordingly, the pixel driving circuit and driving method thereof, and the display device provided by the present disclosure may achieve at least following beneficial effects. In the pixel driving circuit and driving method thereof, and the display device provided by the present disclosure, the first initialization unit and the second initialization unit may be introduced, and both the first initialization unit and the second initialization unit may be electrically connected to the first node in the pixel driving circuit. In the initialization stage in the driving mode at low frequencies (i.e., the first-frequency driving mode), the first initialization unit may be turned on, the second initialization unit may be turned off, and the voltage signal at the first initialization signal terminal may be transmitted to the first node. In the initialization stage in the driving mode with a substantially high frequency (i.e., the second-frequency driving mode), the second initialization unit may be turned on, the first initialization unit may be turned off, and the voltage signal at the second initialization signal terminal may be transmitted to the first node.

In the light-emitting stage, both the first initialization unit and the second initialization unit may be turned off. The first initialization unit and the second initialization unit may have leakage currents, and the polarities of the voltage signals at the first initialization signal terminal and the second initialization signal terminal may be opposite. Therefore, in the leakage currents applied to the first node by the first initialization unit and the second initialization unit, one of them may increase the potential of the first node, and another one may decrease the potential of the first node, which may substantially well compensate for the potential of the first node. Thus, the potential of the first node N1 may be substantially well maintained, which may reduce or eliminate the occurrence of flicker phenomenon of the display device, due to the decrease in the amplitude of the potential of the first node N1 and a substantially long time-length at decreased potential in the driving mode at low frequencies. This improves the display effect of the display device in the driving mode at low frequencies.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments illustrated herein but is to be accorded the widest scope consistent with the principles and novel features disclosed herein.

What is claimed is:

1. A pixel driving circuit, comprising:

a first power signal terminal and a second power signal terminal;

a driving transistor, wherein a gate electrode of the driving transistor is connected to a first node, a first end of the driving transistor is connected to a second node, and a second end of the driving transistor is connected to a third node;

a light-emitting component, connected in series between a fourth node and the second power signal terminal;

a storage unit, wherein a first end of the storage unit is connected to a fixed potential, and a second end of the storage unit is electrically connected to the first node;

a first initialization unit, wherein a first end of the first initialization unit is connected to the first node, a second end of the first initialization unit is connected to a first initialization signal terminal, and a control terminal of the first initialization unit is connected to a first control signal terminal; and a second initialization unit, wherein a first end of the second initialization unit is connected to the first node, a second end of the second initialization unit is connected to a second initialization signal terminal, and a control terminal of the second initialization unit is connected to a second control signal terminal, wherein:

the pixel driving circuit is configured to operate in a first-frequency driving mode at a first frequency and a second-frequency driving mode at a second frequency, wherein the first frequency is less than the second frequency, in the first-frequency driving mode: in an initialization stage, the first initialization unit is turned on, the second initialization unit is turned off, and a voltage signal at the first initialization signal terminal is transmitted to the first node, in the second-frequency driving mode: in an initialization stage, the second initialization unit is turned on, the first initialization unit is turned off, and a voltage signal at the second initialization signal terminal is transmitted to the first node, and in a time-length of one frame, polarities of the voltage signals at the first initialization signal terminal and the second initialization signal terminal are opposite, in a light-emitting stage, the first initialization unit and the second initialization unit both are turned off.

2. The pixel driving circuit according to claim 1, wherein:

the first frequency is $f_1$, and the second frequency is $f_2$, wherein $f_1 \leq 50$ Hz, and 50 Hz$<f_2<$90 Hz.

3. The pixel driving circuit according to claim 1, wherein:

absolute values of signal values of the voltage signals at the first initialization signal terminal and the second initialization signal terminal are equal.

4. The pixel driving circuit according to claim 1, wherein:

the first initialization unit includes a first transistor, wherein a gate electrode of the first transistor is connected to the first control signal terminal, a first end of the first transistor is connected to the first node, and a second end of the first transistor is connected to the first initialization signal terminal, wherein:

the first transistor is a P-type transistor, in the first-frequency driving mode, in the initialization stage, a signal value of the voltage signal at the first initialization signal terminal is a negative value, and a signal value of the voltage signal at the second initialization signal terminal is a positive value.

5. The pixel driving circuit according to claim 4, further including:

a first switching unit electrically connected to the first initialization signal terminal, wherein the first switching unit includes a first switching transistor and a second switching transistor, first ends of both the first switching transistor and the second switching transistor are electrically connected to the first initialization signal terminal, a second end of the first switching transistor is connected to a first positive voltage signal terminal, and a second end of the second switching transistor is connected to a first negative voltage signal terminal, a control terminal of the first switching transistor is connected to a first switch control signal terminal, and a control terminal of the second switching transistor is connected to a second switch control signal terminal.

6. The pixel driving circuit according to claim 5, wherein:

one of the first switching transistor and the second switching transistor is a P-type transistor, another one of the first switching transistor and the second switching transistor is an N-type transistor, and the second switch control signal terminal multiplexes the first switch control signal terminal.

7. The pixel driving circuit according to claim 4, wherein:

the second initialization unit includes a second transistor, wherein a gate electrode of the second transistor is connected to the second control signal terminal, a first end of the second transistor is connected to the first node, and a second end of the second transistor is connected to the second initialization signal terminal, wherein:

the second transistor is a P-type transistor, in the second-frequency driving mode, in the initialization stage, a signal value of the voltage signal at the second initialization signal terminal is a negative value, and a signal value of the voltage signal at the first initialization signal terminal is a positive value.

8. The pixel driving circuit according to claim 7, further including:

a second switching unit electrically connected to the second initialization signal terminal, wherein the second switching unit includes a third switching transistor and a fourth switching transistor, first ends of the third switching transistor and the fourth switching transistor both are electrically connected to the second initialization signal terminal, a second end of the third switching transistor is connected to a second positive voltage signal terminal, a second end of the fourth switching transistor is connected to a second negative voltage signal terminal, a control terminal of the third switching transistor is connected to a third switch control signal terminal, and a control terminal of the fourth switching transistor is connected to a fourth switch control signal terminal.

9. The pixel driving circuit according to claim 8, wherein:

one of the third switching transistor and the fourth switching transistor is a P-type transistor, another one of the third switching transistor and the fourth switching transistor is an N-type transistor, and the fourth switch control signal terminal multiplexes the third switch control signal terminal.

10. The pixel driving circuit according to claim 7, wherein:

in the first-frequency driving mode or the second-frequency driving mode, in the initialization stage, one of signal values of the voltage signals at the first initialization signal terminal and the second initialization signal terminal is a positive value $V_{ref\text{-}positive}$, another one of the signal values is a negative value $V_{ref\text{-}negative}$, and a voltage value of the first node is $V_0$, wherein:

$$(V_{ref\text{-}positive} - V_0)\times\left(\frac{1}{f_2}\times\frac{W_1}{L_1}+\frac{1}{f_1}\times\frac{W_2}{L_2}\right) = (V_0 - V_{ref\text{-}negative})\times\left(\frac{1}{f_1}\times\frac{W_1}{L_1}+\frac{1}{f_2}\times\frac{W_2}{L_2}\right),$$

$f_1$ is the first frequency, $f_2$ is the second frequency, $W_1$ is a channel width of the first transistor, $L_1$ is a channel length of the first transistor, $W_2$ is a channel width of the second transistor, and $L_2$ is a channel length of the second transistor.

11. The pixel driving circuit according to claim 10, wherein:

a width-to-length ratio of the first transistor is $A_1$, wherein $A_1=W_1/L_1$;

a width-to-length ratio of the second transistor is $A_2$, wherein $A_2=W_2/L_2$; and $A_1$ is less than $A_2$.

12. The pixel driving circuit according to claim 11, wherein:

$L_1>L_2$, or $W_1<W_2$.

13. The pixel driving circuit according to claim 11, wherein:

$$A_2 = A_1 \times \frac{f_2}{f_1}.$$

14. The pixel driving circuit according to claim 1, further including:

a data writing unit and a compensation unit, wherein a first end of the data writing unit is connected to a data signal terminal, a second end of the data writing unit is connected to the second node, a control terminal of the data writing unit is connected to a third control signal terminal, a first end of the compensation unit is connected to the first node, a second end of the compensation unit is connected to the third node, and a control terminal of the compensation unit is connected to the third control signal terminal;

in the data writing stage, the data writing unit and the compensation unit are turned on, the data signal terminal transmits a data signal to the second node, a signal of the second node is transmitted to the third node through the driving transistor, and a signal of the third node is transmitted to the first node through the compensation unit to provide the first node with a voltage value $V_0$; and in the first-frequency driving mode, a voltage value of the second initialization signal terminal is $V_2$, wherein $V_2>V_0$; and in the second-frequency driving mode, a voltage value of the first initialization signal terminal is $V_3$, wherein $V_3>V_0$.

15. The pixel driving circuit according to claim 1, further including:

a light-emitting control unit, wherein the light-emitting control unit, the driving transistor, and the light-emitting component are connected in series between the first power signal terminal and the second power signal terminal, and the light-emitting control unit is electrically connected to a light-emitting control signal terminal through a light-emitting control line;

the light-emitting control signal terminal receives a light-emitting control signal, and transmits the light-emitting control signal to the light-emitting control unit through the light-emitting control line, to enable the light-emitting control unit to be turned on; and the first initialization unit and the second initialization unit generate leakage currents with opposite polarities, and transmit the leakage currents to the first node, respectively, and the driving transistor generates a driving current and transmit the driving current to the light-emitting component.

16. A driving method of a pixel driving circuit, comprising:

providing a pixel driving circuit, including:

a first power signal terminal and a second power signal terminal, a driving transistor, wherein a gate electrode of the driving transistor is connected to a first node, a first end of the driving transistor is connected to a second node, and a second end of the driving transistor is connected to a third node, a light-emitting component, connected in series between a fourth node and the second power signal terminal, a storage unit, wherein a first end of the storage unit is connected to a fixed potential, and a second end of the storage unit is electrically connected to the first node, a first initialization unit, wherein a first end of the first initialization unit is connected to the first node, a second end of the first initialization unit is connected to a first initialization signal terminal, and a control terminal of the first initialization unit is connected to a first control signal terminal, and a second initialization unit, wherein a first end of the second initialization unit is connected to the first node, a second end of the second initialization unit is connected to a second initialization signal terminal, and a control terminal of the second initialization unit is connected to a second control signal terminal, wherein:

the pixel driving circuit is configured to operate in a first-frequency driving mode at a first frequency and a second-frequency driving mode at a second frequency, wherein the first frequency is less than the second frequency;

in the first-frequency driving mode: in the initialization stage, sending a first control signal from the first control signal terminal to the first initialization unit, and sending a second control signal from the second control signal terminal to the second initialization signal terminal, such that the first initialization unit is turned on, the second initialization unit is turned off, and a voltage signal is transmitted from the first initialization signal terminal to the first node;

in the second-frequency driving mode: in the initialization stage, sending a third control signal from the first control signal terminal to the first initialization unit, and sending a fourth control signal from the second control signal terminal to the second initialization signal terminal, such that the second initialization unit is turned on, the first initialization unit is turned off, and a voltage signal is transmitted from the second initialization signal terminal to the first node, wherein in a time-length of one frame, polarities of the voltage signals at the first initialization signal terminal and the second initialization signal terminal are opposite; and in a light-emitting stage, turning off the first initialization unit and the second initialization unit.

17. The driving method according to claim 16, wherein:

the pixel driving circuit further includes a data writing unit and a compensation unit, wherein a first end of the data writing unit is connected to a data signal terminal, a second end of the data writing unit is connected to the second node, a control terminal of the data writing unit is connected to a third control signal terminal, a first end of the compensation unit is connected to the first node, a second end of the compensation unit is connected to the third node, and a control terminal of the compensation unit is connected to the third control signal terminal; and the method further includes:

in a data writing stage, using the third control signal terminal to control the data writing unit and the compensation unit to be turned on, using the data signal terminal to transmit a data signal to the second node, transmitting a signal of the second node to the third node through the driving transistor, and transmitting a signal of the third node to the first node through the compensation unit to provide the first node with a voltage value $V_0$, wherein:

in the first-frequency driving mode, a voltage value of the second initialization signal terminal is $V_2$, wherein $V_2>V_0$; and in the second-frequency driving mode, a voltage value of the first initialization signal terminal is $V_3$, wherein $V_3>V_0$.

18. The driving method according to claim 17, wherein:

the pixel driving circuit further includes a light-emitting control unit, wherein the light-emitting control unit is electrically connected to a light-emitting control signal terminal through a light-emitting control line; and the method further includes:

in the light-emitting stage, using the light-emitting control signal terminal to transmit a light-emitting control signal to the light-emitting control unit, to enable the light-emitting control unit to be turned on, and under actions of the voltage signals at the first initialization signal terminal and the second initialization signal terminal, generating, by the first initialization unit and the second initialization unit, leakage currents with opposite polarities, respectively; transmitting, by the first initialization unit and the second initialization unit, the leakage currents to the first node, respectively; and generating, by the driving transistor, a driving current, and transmitting, by the driving transistor, the driving current to the light-emitting component.

19. A display device, comprising a pixel driving circuit, wherein the pixel driving circuit includes:

a first power signal terminal and a second power signal terminal;

a driving transistor, wherein a gate electrode of the driving transistor is connected to a first node, a first end of the driving transistor is connected to a second node, and a second end of the driving transistor is connected to a third node;

a light-emitting component, connected in series between a fourth node and the second power signal terminal;

a storage unit, wherein a first end of the storage unit is connected to a fixed potential, and a second end of the storage unit is electrically connected to the first node;

a first initialization unit, wherein a first end of the first initialization unit is connected to the first node, a second end of the first initialization unit is connected to a first initialization signal terminal, and a control terminal of the first initialization unit is connected to a first control signal terminal; and a second initialization unit, wherein a first end of the second initialization unit is connected to the first node, a second end of the second initialization unit is connected to a second initialization signal terminal, and a control terminal of the second initialization unit is connected to a second control signal terminal, wherein:

the pixel driving circuit is configured to operate in a first-frequency driving mode at a first frequency and a second-frequency driving mode at a second frequency, wherein the first frequency is less than the second frequency, in the first-frequency driving mode: in an initialization stage, the first initialization unit is turned on, the second initialization unit is turned off, and a voltage signal at the first initialization signal terminal is transmitted to the first node, in the second-frequency driving mode: in an initialization stage, the second initialization unit is turned on, the first initialization unit is turned off, and a voltage signal at the second initialization signal terminal is transmitted to the first node, and in a time-length of one frame, polarities of the voltage signals at the first initialization signal terminal and the second initialization signal terminal are opposite, in a light-emitting stage, the first initialization unit and the second initialization unit both are turned off.

* * * * *